US012628870B2

(12) United States Patent
Lee et al.

(10) Patent No.: US 12,628,870 B2
(45) Date of Patent: May 19, 2026

(54) CARTRIDGE FOR AEROSOL-GENERATING DEVICE AND AEROSOL-GENERATING DEVICE INCLUDING THE SAME

(71) Applicant: KT&G CORPORATION, Daejeon (KR)

(72) Inventors: Won Kyeong Lee, Gyeonggi-do (KR); Jong Sub Lee, Gyeonggi-do (KR); Byung Sung Cho, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 495 days.

(21) Appl. No.: 17/916,936

(22) PCT Filed: Jul. 12, 2022

(86) PCT No.: PCT/KR2022/010125
§ 371 (c)(1),
(2) Date: Oct. 4, 2022

(87) PCT Pub. No.: WO2023/018022
PCT Pub. Date: Feb. 16, 2023

(65) Prior Publication Data

US 2024/0315330 A1 Sep. 26, 2024

(30) Foreign Application Priority Data

Aug. 12, 2021 (KR) ..... 10-2021-0106936
Jan. 12, 2022 (KR) ..... 10-2022-0004770

(51) Int. Cl.
*A24F 40/42* (2020.01)
*A24F 40/05* (2020.01)
(Continued)

(52) U.S. Cl.
CPC ..... *A24F 40/42* (2020.01); *A24F 40/05* (2020.01); *A24F 40/10* (2020.01); *A24F 40/44* (2020.01); *A24F 40/485* (2020.01); *A24F 40/95* (2020.01)

(58) Field of Classification Search
None
See application file for complete search history.

(56) References Cited

U.S. PATENT DOCUMENTS 10,757,971 B2 9/2020 Liu et al.
2013/0319404 A1 12/2013 Feriani et al.
(Continued)

FOREIGN PATENT DOCUMENTS

CN 205947119 U 2/2017
CN 209376678 U 9/2019
(Continued)

OTHER PUBLICATIONS

CN-209732606-U Claims English Translation obtained from Espacenet, pp. 1-9 (Year: 2024).*
(Continued)

*Primary Examiner* — Philip Y Louie
*Assistant Examiner* — Virginia R Bieger
(74) *Attorney, Agent, or Firm* — Sughrue Mion, PLLC

(57) ABSTRACT

A cartridge for an aerosol generating device includes: a storage in which an aerosol generating material is stored; a vibrator configured to atomize the aerosol generating material stored in the storage into an aerosol by generating vibrations; a delivery portion configured to deliver the aerosol generating material stored in the storage to the vibrator; a first conductor having a container shape, the first conductor in contact with a first surface of the vibrator and accommodating at least a portion of an outer circumferential surface of the vibrator; a second conductor in contact with
(Continued)

a second surface of the vibrator and pressing the vibrator in a direction from the second surface to the first surface; and a support located inside the first conductor and configured to support the vibrator.

14 Claims, 10 Drawing Sheets

(51) Int. Cl.

| | |
|---|---|
| ***A24F 40/10*** | (2020.01) |
| ***A24F 40/44*** | (2020.01) |
| ***A24F 40/485*** | (2020.01) |
| ***A24F 40/95*** | (2020.01) |

(56) References Cited

U.S. PATENT DOCUMENTS

| | | | | |
|---|---|---|---|---|
| 2017/0245550 | A1* | 8/2017 | Freelander | A24F 40/50 |
| 2018/0161525 | A1* | 6/2018 | Liu | B05B 17/0661 |
| 2019/0150519 | A1 | 5/2019 | Liu et al. | |
| 2019/0216135 | A1 | 7/2019 | Guo et al. | |
| 2020/0060349 | A1 | 2/2020 | Danek | |
| 2020/0146353 | A1* | 5/2020 | Liu | A24F 40/50 |
| 2022/0175049 | A1 | 6/2022 | Memari et al. | |
| 2024/0090564 | A1 | 3/2024 | Fu et al. | |

FOREIGN PATENT DOCUMENTS

| | | | | |
|---|---|---|---|---|
| CN | 209732606 | U | * | 12/2019 |
| CN | 111567882 | A | | 8/2020 |
| CN | 211861795 | U | | 11/2020 |
| CN | 112351697 | A | | 2/2021 |
| KR | 10-2013-0116887 | A | | 10/2013 |
| KR | 10-2018-0044978 | A | | 5/2018 |
| KR | 10-2247430 | B1 | | 4/2021 |
| WO | 2012/062600 | A1 | | 5/2012 |
| WO | 2016/019353 | A1 | | 2/2016 |
| WO | 2020/115175 | A1 | | 6/2020 |

OTHER PUBLICATIONS

Korean Office Action issued Jul. 18, 2023 in Application No. 10-2022-0004770.

Communication dated Dec. 7, 2023 issued by the European Patent Office in application No. 22773584.2.

Written Opinion of the International Searching Authority dated Oct. 24, 2022 in International Application No. PCT/KR2022/010125.

International Search Report dated Oct. 24, 2022 in International Application No. PCT/KR2022/010125.

Chinese Office Action dated Nov. 8, 2025 in Application No. 202280002931.8.

* cited by examiner

[Fig. 1]
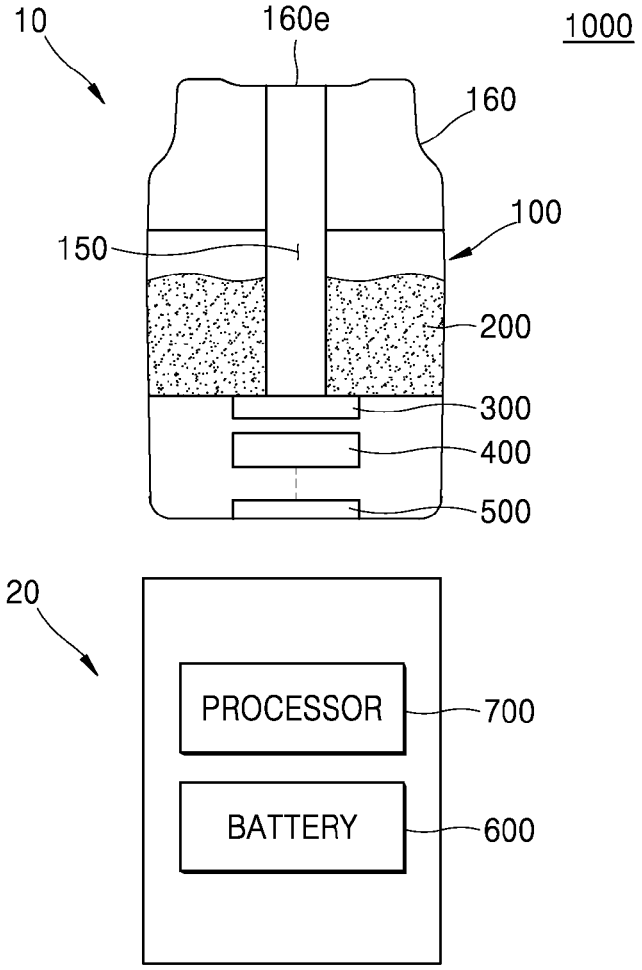

[Fig. 2]
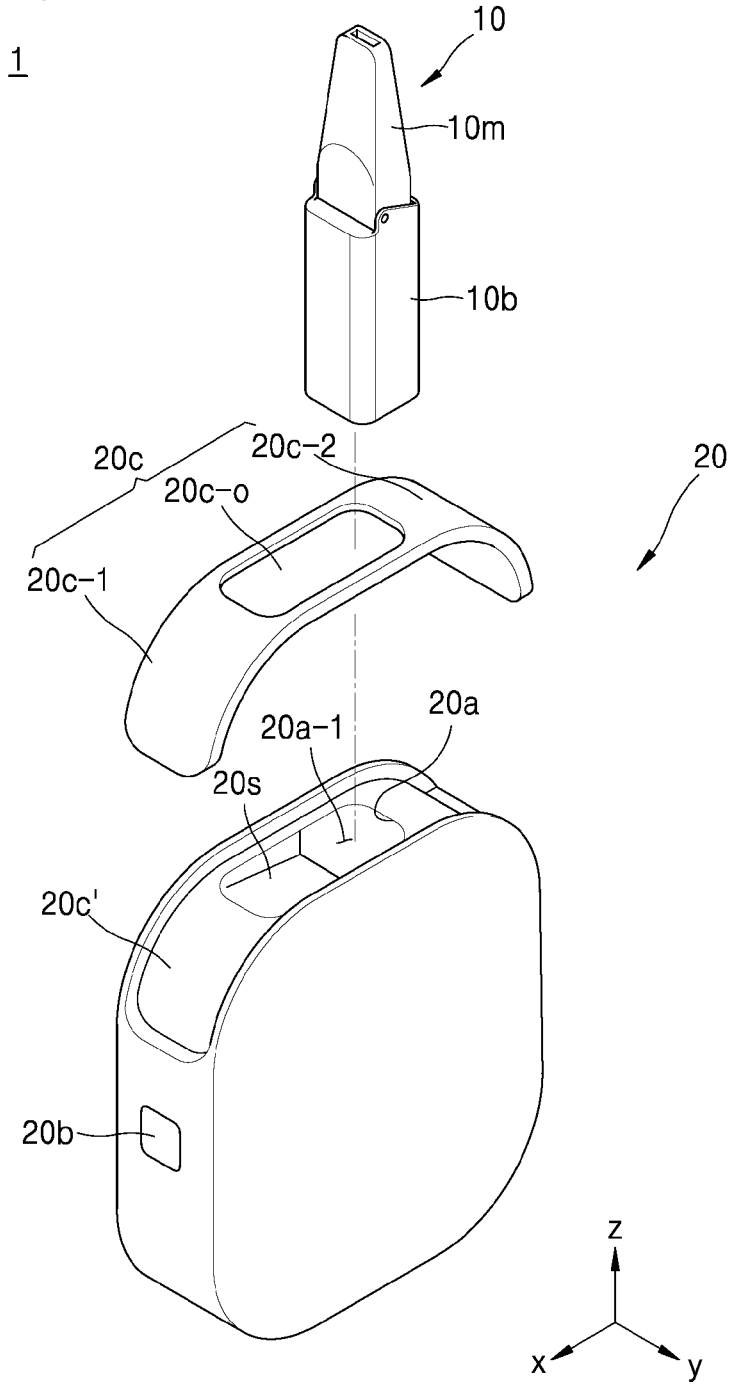

[Fig. 3]
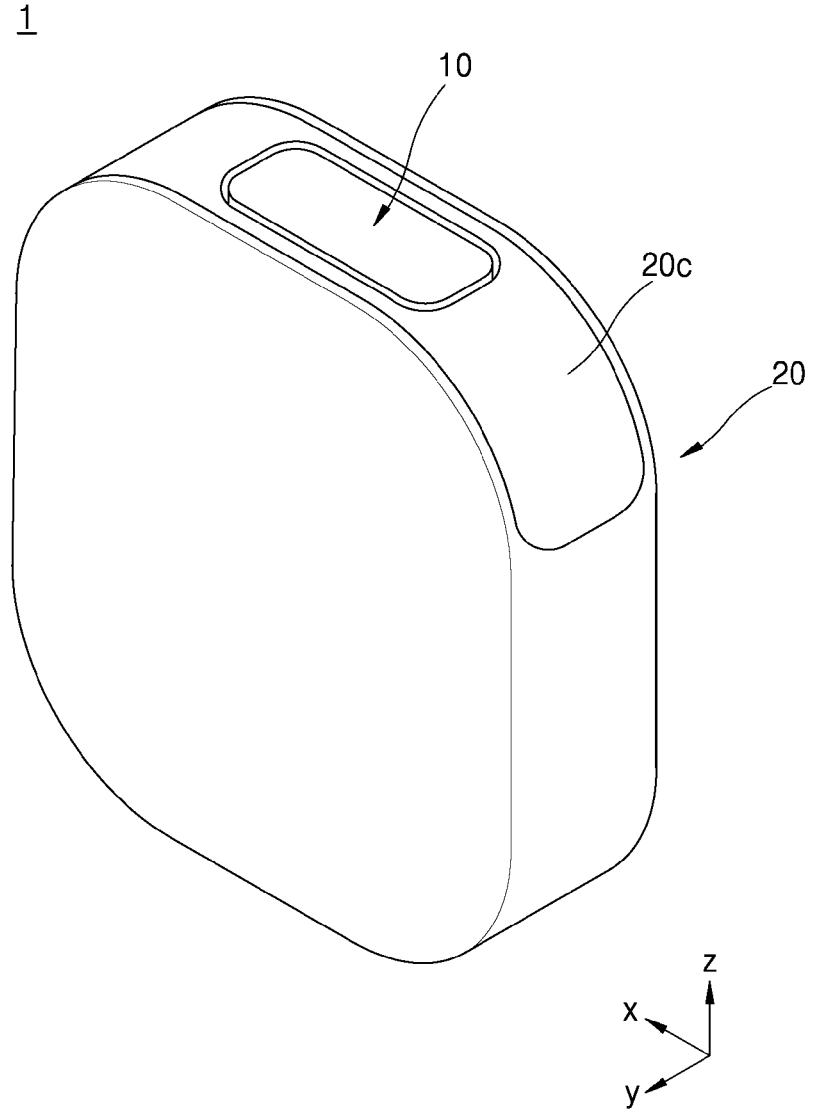

[Fig. 4]
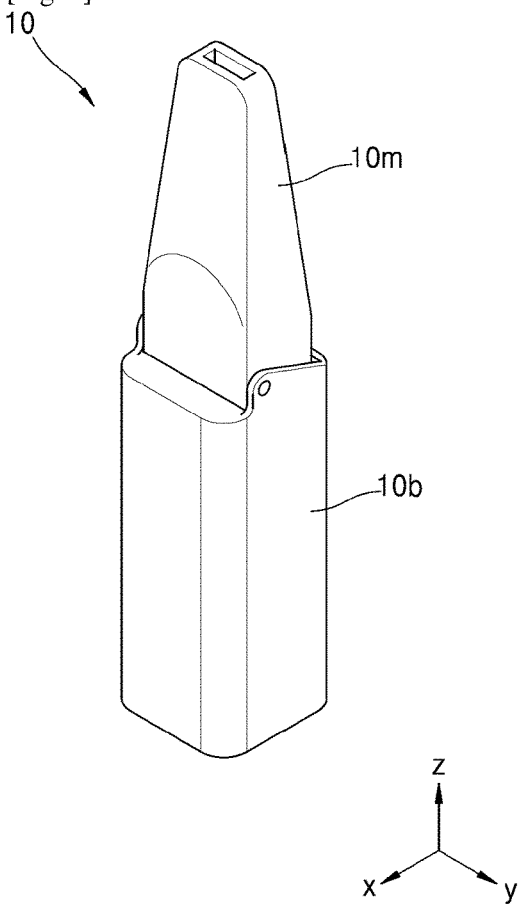
[Fig. 5]
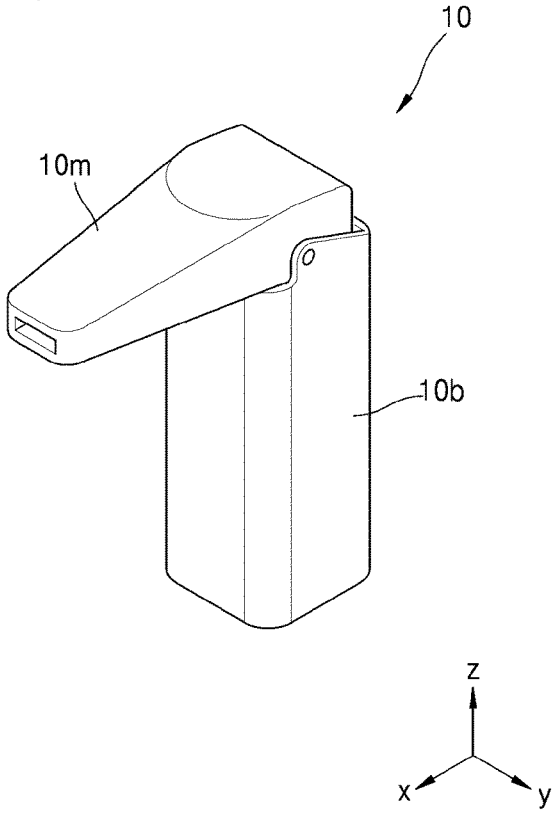

[Fig. 6]
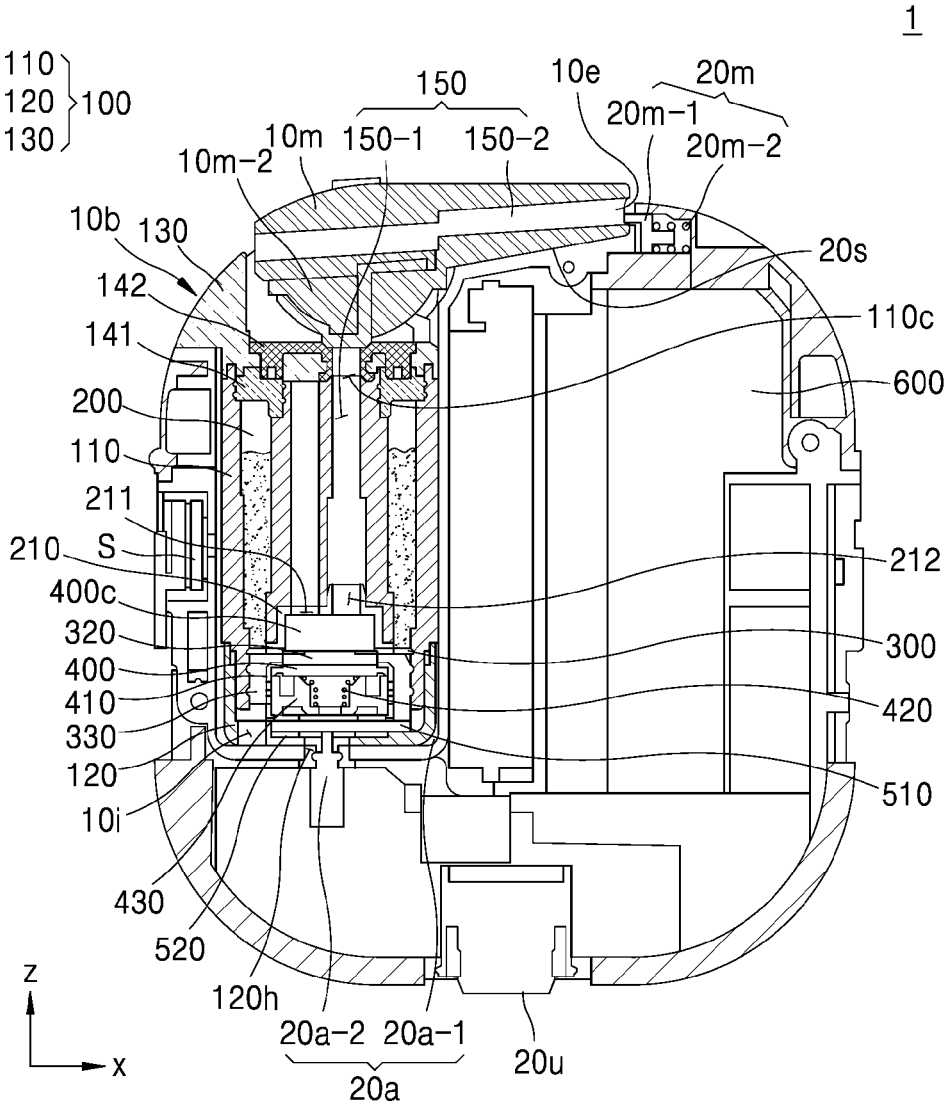

[Fig. 7]
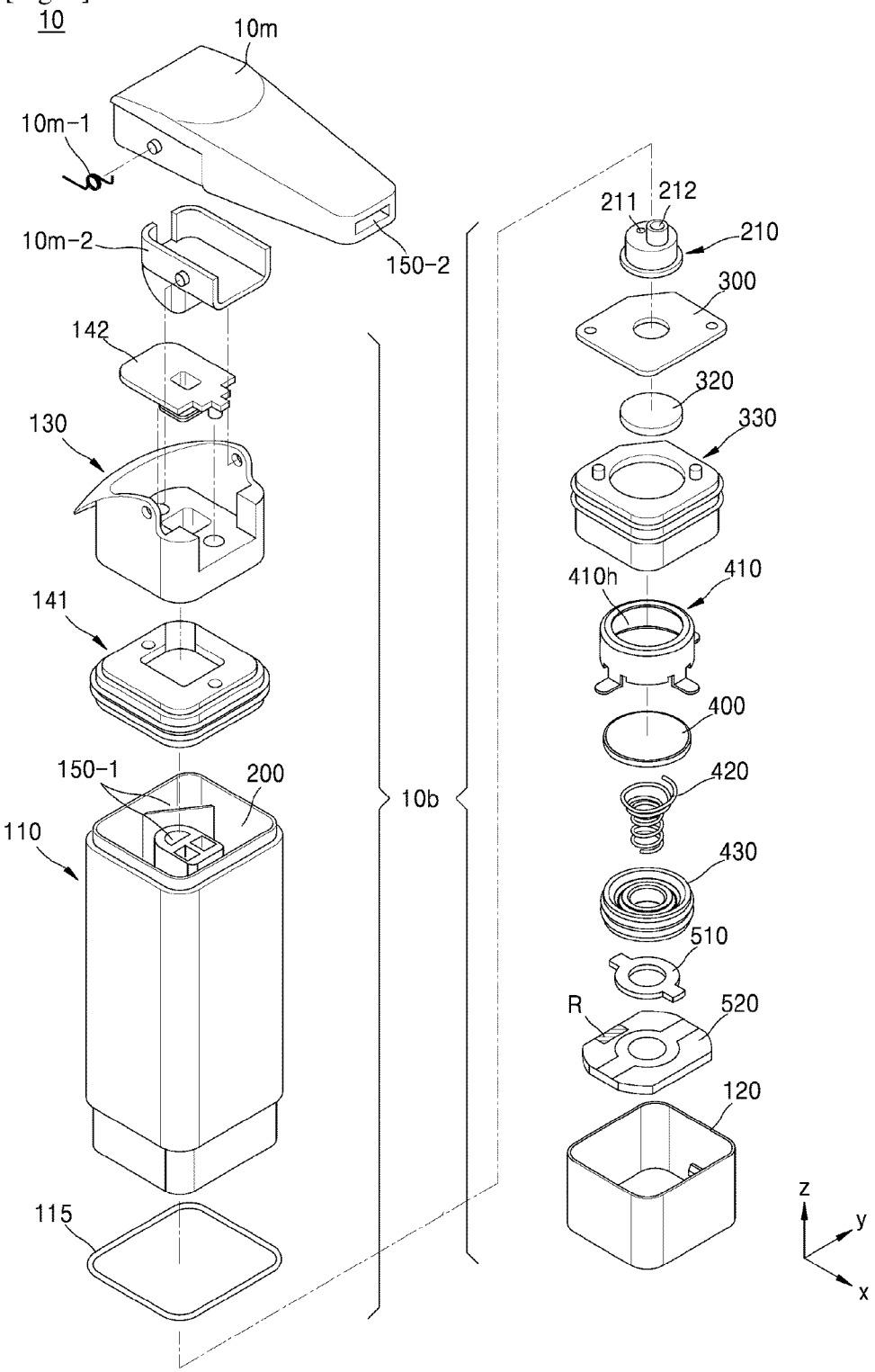

[Fig. 8A]
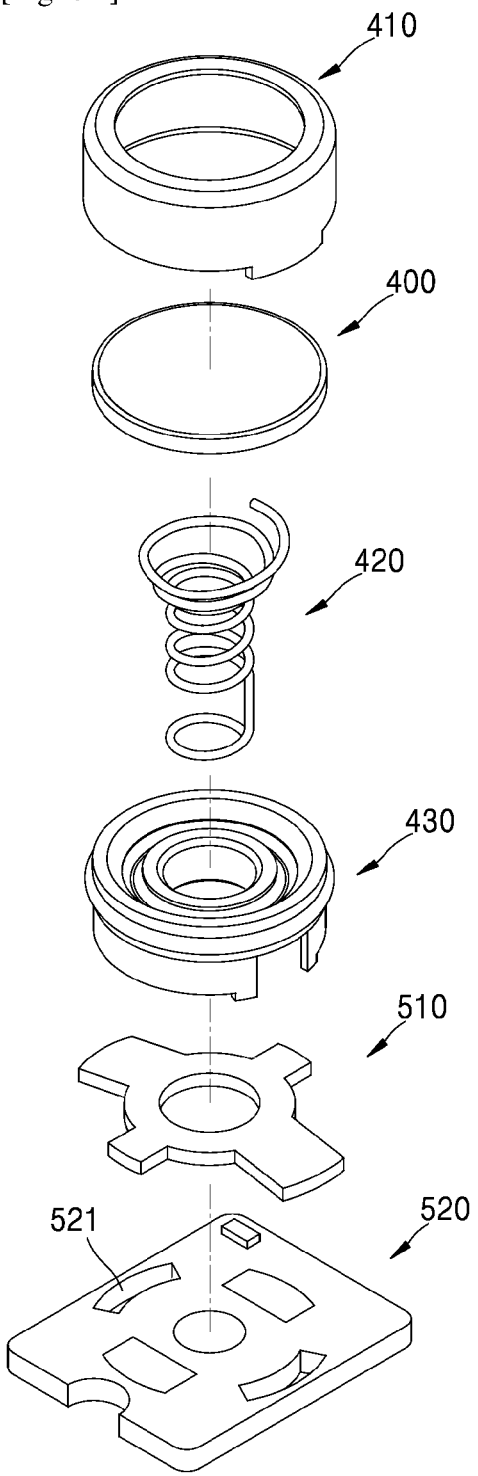

[Fig. 8B]
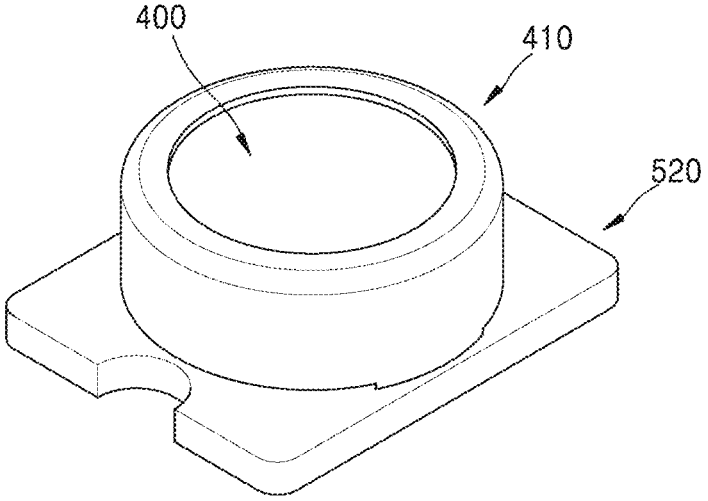
[Fig. 8C]
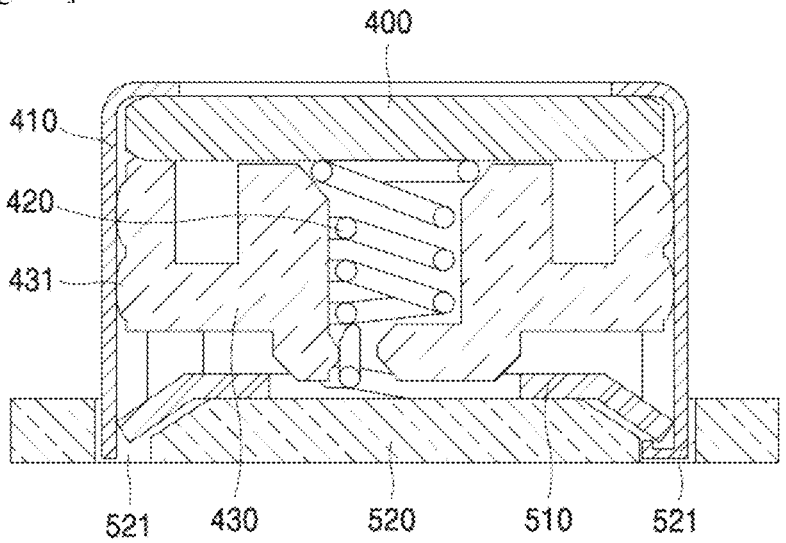
[Fig. 9A]
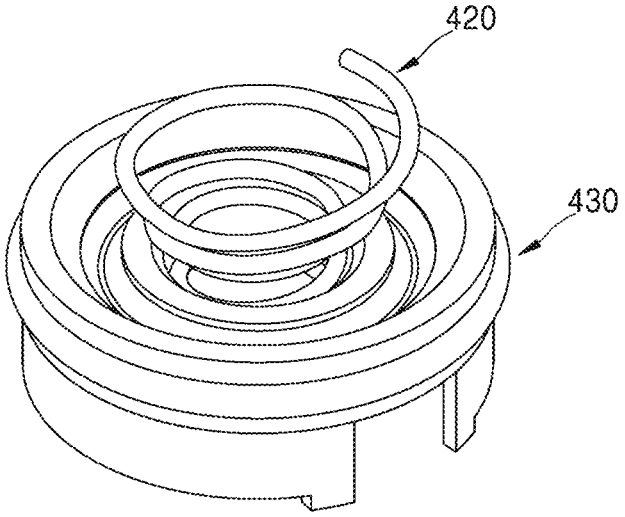

[Fig. 9B]
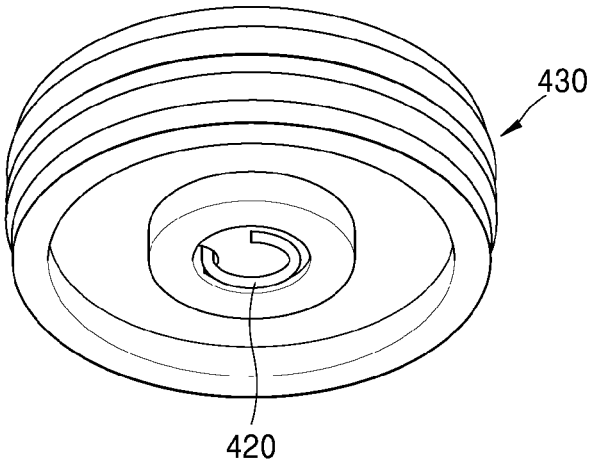
[Fig. 10]
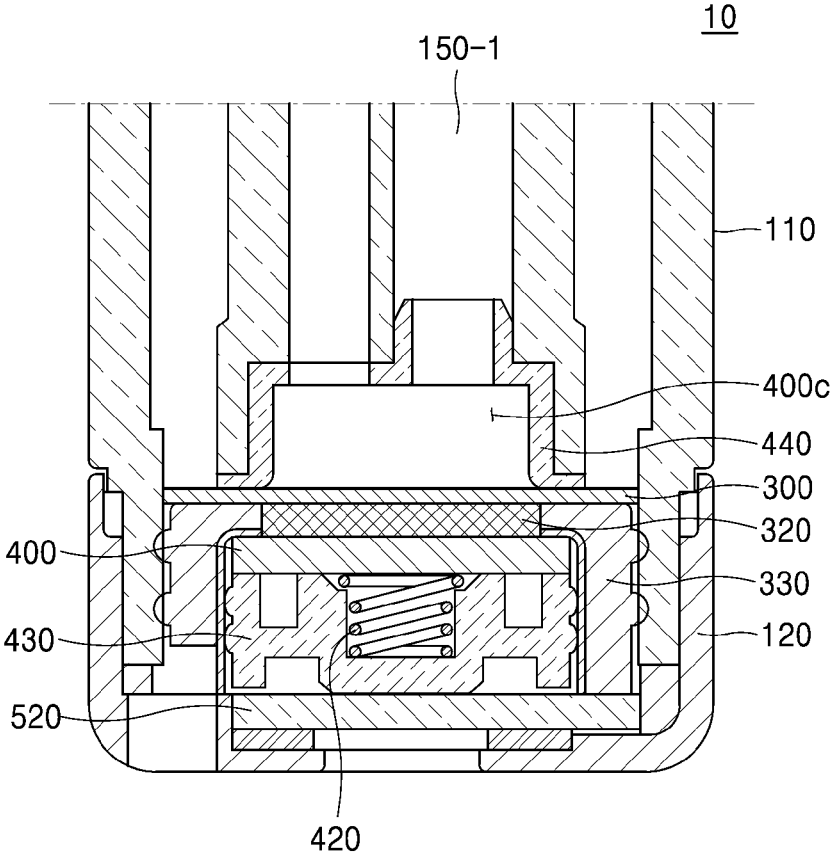

[Fig. 11]
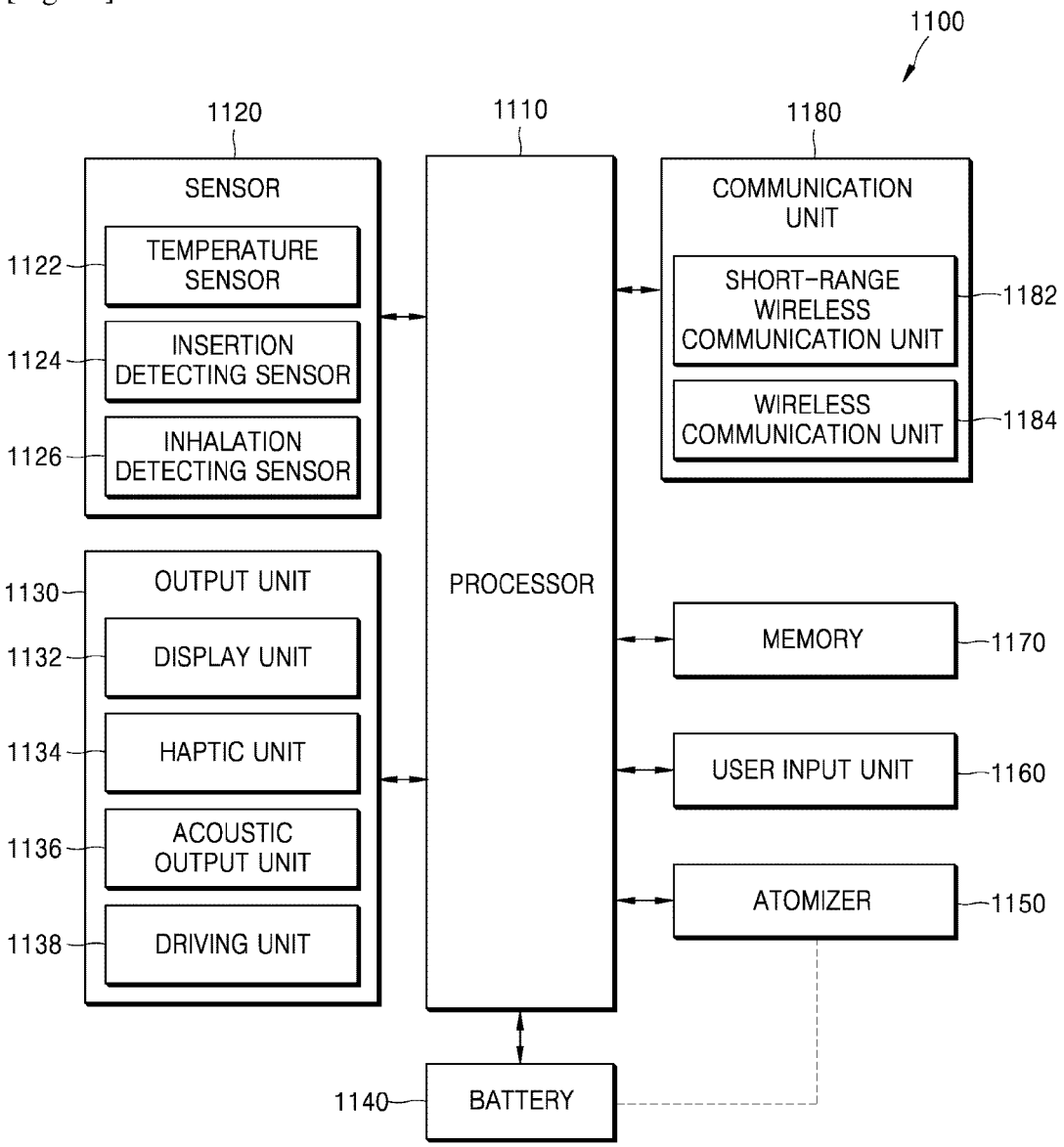

CARTRIDGE FOR AEROSOL-GENERATING DEVICE AND AEROSOL-GENERATING DEVICE INCLUDING THE SAME

CROSS REFERENCE TO RELATED APPLICATIONS

This application is a National Stage of International Application No. PCT/KR2022/010125, filed Jul. 12, 2022, claiming priorities to Korean Patent Application No. 10-2021-0106936, filed Aug. 12, 2021 and Korean Patent Application No. 10-2022-0004770, filed Jan. 12, 2022.

TECHNICAL FIELD

Embodiments of the present disclosure provide a cartridge for an aerosol generating device and an aerosol generating device including the cartridge, and more particularly, an aerosol generating device using vibration of a vibrator, wherein deformation of or damage to components of the aerosol generating device may be prevented.

BACKGROUND ART

Recently, the demand for alternative methods to overcome the shortcomings of general cigarettes has increased. For example, research has been conducted to supply an aerosol having flavor by generating an aerosol from an aerosol generating material in a liquid or solid state or generating a vapor from an aerosol generating material in a liquid state, and then by passing the generated vapor through a solid fragrance medium.

Recently, an aerosol generating device including a cartridge that may store an aerosol generating material and atomize the stored aerosol generating material, and a main body accommodating the cartridge and supplying power to the accommodated cartridge has been suggested.

DISCLOSURE OF INVENTION

Technical Problem

An aerosol generating device may generate an aerosol by using vibration of a vibrator generated by applying an alternating voltage to the vibrator. Also, heat may be generated by the vibration of the vibrator. The viscosity of an aerosol generating material in contact with the vibrator may be lowered due to the heat generated in the vibrator, and the aerosol generating material may be atomized to thereby generate an aerosol.

The aerosol generating device of the related art using the vibration of the vibrator has problems such as deformation or damage to surrounding components including the vibrator due to the instantaneous vibration and temperature rise generated by the vibrator at the start of an operation.

Solution to Problem

Embodiments of the present disclosure provide, in relation to an aerosol generating device that uses vibration of a vibrator, a cartridge for an aerosol generating device that may prevent components of the aerosol generating device from being deformed or damaged, and an aerosol generating device including the cartridge.

Technical problems to be solved by embodiments of the present disclosure are not limited to the above-described problems, and problems that are not mentioned will be clearly understood by those of ordinary skill in the art from the present disclosure and the accompanying drawings.

According to one or more embodiments, a cartridge for an aerosol generating device includes: a storage in which an aerosol generating material is stored; a vibrator configured to atomize the aerosol generating material stored in the storage into an aerosol by generating vibrations; a delivery portion configured to deliver the aerosol generating material stored in the storage to the vibrator; a first conductor having a container shape, the first conductor in contact with a first surface of the vibrator and accommodating at least a portion of an outer circumferential surface of the vibrator; a second conductor in contact with a second surface of the vibrator and pressing the vibrator in a direction from the second surface to the first surface; and a support located inside the first conductor and configured to support the vibrator.

According to one or more embodiments, the aerosol generating device includes: a cartridge for the aerosol generating device; and a main body to which the cartridge is detachably coupled, wherein the main body for the aerosol generating device includes: a housing including an accommodating groove into which at least a portion of the cartridge is inserted; and a battery configured to supply power to the cartridge.

Means for achieving aspects of the present disclosure are not limited to the above description and may include all matters that may be inferred by those skilled in the art throughout the present specification.

Advantageous Effects of Invention

Embodiments of the present disclosure, including a cartridge for an aerosol generating device and an aerosol generating device including the cartridge, may prevent deformation of or damage to the vibrator and surrounding components of the cartridge due to instantaneous vibration and temperature rise occurring in the vibrator.

Effects of embodiments of the present disclosure are not limited to the effects described above and may include all effects that may be inferred from configurations to be described below.

BRIEF DESCRIPTION OF DRAWINGS

FIG. 1 is a schematic view of an aerosol generating device according to an embodiment.

FIG. 2 is a perspective view of the cartridge and the main body of the aerosol generating device according to another embodiment, separated from each other.

FIG. 3 is a perspective view of the main body and the cartridge of the aerosol generating device according to the embodiment of FIG. 2, coupled to each other.

FIG. 4 is a diagram showing an aspect of the cartridge according to the embodiment of FIG. 2.

FIG. 5 is a diagram showing another aspect of the cartridge according to the embodiment of FIG. 2.

FIG. 6 is a cross-sectional view of an aerosol generating device according to the embodiment of FIG. 2.

FIG. 7 is an exploded perspective view of the cartridge according to the embodiment of FIG. 2.

FIG. 8A is an exploded perspective view of some components of the cartridge according to an embodiment.

FIG. 8B is a perspective view of a combination of the components shown in the embodiment of FIG. 8A.

FIG. 8C is a cross-sectional view of the configurations shown in FIG. 8B.

FIG. 9A is a perspective view of a support in which a second conductor shown in the embodiment of FIG. 8A is accommodated.

FIG. 9B is a perspective view showing the support of FIG. 9A from a different angle from that of FIG. 9A.

FIG. 10 is a cross-sectional view of the cartridge for the aerosol generating device according to an embodiment.

FIG. 11 is a block diagram of an aerosol generating device according to another embodiment.

BEST MODE FOR CARRYING OUT THE INVENTION

According to embodiments of the present disclosure, a cartridge for an aerosol generating device is provided. The cartridge includes: a storage in which an aerosol generating material is stored; a vibrator configured to atomize the aerosol generating material stored in the storage into an aerosol by generating vibrations; a delivery portion configured to deliver the aerosol generating material stored in the storage to the vibrator; a first conductor having a container shape, the first conductor in contact with a first surface of the vibrator and accommodating at least a portion of an outer circumferential surface of the vibrator; a second conductor in contact with a second surface of the vibrator and pressing the vibrator in a direction from the second surface to the first surface; and a support located inside the first conductor and configured to support the vibrator.

According to one or more embodiments of the present disclosure, at least a portion of the support is surrounded by the first conductor, and the portion of the support surrounded by the first conductor includes at least one protrusion.

According to one or more embodiments of the present disclosure, an end of the second conductor is supported by the support.

According to one or more embodiments of the present disclosure, the second conductor has elasticity and is compressed between the support and the second surface of the vibrator such as to support the vibrator.

According to one or more embodiments of the present disclosure, the support includes an accommodation space that accommodates the second conductor inside the support.

According to one or more embodiments of the present disclosure, the second conductor has a coil shape, the coil shape comprising a first end in contact with the vibrator and a second end that is located inside the accommodation space, and a diameter of the first end of the coil shape is greater than a diameter of the second end of the coil shape.

According to one or more embodiments of the present disclosure, the cartridge further includes a circuit board electrically connected to the first conductor and the second conductor to supply signals to the vibrator.

According to one or more embodiments of the present disclosure, the circuit board includes a resistor that reduces noise of a signal applied to the vibrator.

According to one or more embodiments of the present disclosure, at least a portion of the first conductor that surrounds the outer circumferential surface of the vibrator is fastened to the circuit board.

According to one or more embodiments of the present disclosure, the aerosol generating device further includes a support plate located between the support and the circuit board, wherein at least a portion of the support plate is coupled to the circuit board to support the support.

According to one or more embodiments of the present disclosure, the circuit board includes a fastening groove to which a portion of the support is fastened, and at least a portion of the first conductor is coupled to the fastening groove.

According to one or more embodiments of the present disclosure, the aerosol generating device further includes: an airflow passage that is configured to discharge an atomized aerosol; and an atomizing space cover surrounding an atomizing space in which the vibrator is configured to atomize the aerosol, the atomizing space cover configured to allow the aerosol to be delivered from the atomizing space to the airflow passage while limiting the aerosol from leaking to an outside of the airflow passage.

According to one or more embodiments of the present disclosure, the aerosol generating device further includes an absorbent located between the delivery portion and the vibrator, the absorbent configured to deliver the aerosol generating material delivered from the delivery portion to the vibrator.

According to one or more embodiments of the present disclosure, the delivery portion includes a material having an aerosol generating material absorption rate that is faster than an aerosol generating material absorption rate of the absorbent.

According to embodiments of the present disclosure, an aerosol generating device is provided. The aerosol generating device includes the cartridge; and a main body to which the cartridge is detachably coupled, wherein the main body for the aerosol generating device includes: a housing comprising an accommodating groove into which at least a portion of the cartridge is inserted; and a battery configured to supply power to the cartridge.

MODE FOR THE INVENTION

With respect to the terms used to describe the various embodiments, general terms which are currently and widely used are selected in consideration of functions of structural elements in the various embodiments of the present disclosure. However, meanings of the terms can be according to intention, a judicial precedence, the appearance of a new technology, and the like. Also, in a special case, there may be terms that are arbitrarily selected by the applicant. In this case, the meanings of the terms will be described in detail in the description of the present disclosure. Therefore, the terms used to describe the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

In addition, terms including ordinal numbers such as "first" or "second" used in the present specification may be used to describe various components, but the components are not limited by the terms. Terms are used only for the purpose of distinguishing one component from another component.

According to an embodiment, the aerosol generating device may generate aerosol by using a cartridge containing an aerosol generating material.

The aerosol generating device may include a cartridge containing an aerosol generating material and a main body supporting the cartridge. The cartridge may be coupled to the main body to be detachable, but embodiments are not limited thereto. The cartridge may be integrated with or assembled to the main body, and may be fixed so as not to be detached by a user. The cartridge may be coupled to the main body while accommodating aerosol generating material therein. But embodiments are not limited thereto, and the aerosol generating material may be inserted into the cartridge in a state where the cartridge is coupled to the main body.

The cartridge may contain an aerosol generating material in any one of various states such as a liquid state, a solid state, a gaseous state, or a gel state. The aerosol generating material may include a liquid composition. For example, the liquid composition may be a liquid including a tobacco-containing material including a volatile tobacco flavor component or may be a liquid including a non-tobacco material.

The cartridge is operated by an electrical signal or a wireless signal transmitted from the main body to perform a function of generating aerosol by converting the phase of the aerosol generating material inside the cartridge to a gaseous phase. The term "aerosol" described in the specification means a gas in a state in which vaporized particles generated from aerosol generating material and air are mixed.

For example, the aerosol generating device may generate aerosol from the aerosol generating material by using an ultrasonic vibration method. In this case, the ultrasonic vibration method may refer to a method of generating an aerosol by atomizing an aerosol generating material by using ultrasonic vibration generated by a vibrator.

The aerosol generating device may include a vibrator, and the vibrator may generate a short period of vibration to atomize the aerosol generating material. The vibration generated by the vibrator may be an ultrasound vibration, and the frequency band of the ultrasound vibration may be about 100 kHz to about 3.5 MHz, but is not limited thereto.

The aerosol generating device may further include a delivery portion that absorbs the aerosol generating material. For example, the delivery portion may be arranged to surround at least one area of the vibrator or to be in contact with the at least one area of the vibrator.

As voltage (for example, AC voltage) is applied to the vibrator, heat and/or ultrasonic vibration may be generated from the vibrator, and the heat and/or ultrasonic vibration generated from the vibrator may be transmitted to the aerosol generating material absorbed into the delivery portion. The aerosol generating material absorbed by the delivery portion may be converted to a gaseous phase by heat and/or an ultrasound vibration transmitted from the vibrator, and as a result, aerosol may be generated.

For example, the viscosity of the aerosol generating material absorbed by the delivery portion may be lowered by the heat generated from the vibrator, and the aerosol generating material with lowered viscosity due to the ultrasonic vibration generated from the vibrator may change into fine particles, thereby generating aerosol. However, embodiments are not limited thereto.

Hereinafter, non-limiting example embodiments of the present disclosure will be described in detail with reference to the accompanying drawings so that those of ordinary skill in the art may easily implement the embodiments. However, embodiments of the present disclosure may be implemented in various different forms and is not limited to the non-limiting example embodiments described herein.

FIG. 1 is a schematic view of an aerosol generating device according to an embodiment.

Referring to FIG. 1, an aerosol generating device 1000 may include a cartridge 10 storing an aerosol generating material and a main body 20 supporting the cartridge 10.

The cartridge 10 may be coupled to the main body 20 while accommodating aerosol generating material therein. For example, because at least a portion of the cartridge 10 is inserted into the main body 20, the cartridge 10 may be coupled to the main body 20. As another example, because at least a portion of the main body 20 is inserted into the cartridge 10, the cartridge 10 may be coupled to the main body 20.

The cartridge 10 may be coupled to the main body 20 by at least one method selected from a snap-fit method, a screw connection method, a magnetic coupling method, or a forcible fit method. However, methods of coupling the cartridge 10 to the main body 20 are not limited thereto.

According to an embodiment, the cartridge 10 may include a housing 100, a mouthpiece 160, a storage 200, a delivery portion 300, a vibrator 400, and an electrical terminal 500.

The housing 100 may form the overall outer shape of the cartridge 10 together with the mouthpiece 160, and elements for operating the cartridge 10 may be arranged in the housing 100. According to an embodiment, the housing 100 may be formed in a cuboid shape, but the shape of the housing 100 is not limited thereto. According to an embodiment, the housing 100 may be formed in a polygonal pillar (e.g., a triangular pillar or a pentagonal pillar) or a cylindrical shape.

The mouthpiece 160 may disposed in one area of the housing 100 and may include an outlet **160*e* for discharging the aerosol generated from the aerosol generating material to the outside. According to an embodiment, the mouthpiece 160 may be arranged in an area opposite to another area of the cartridge 10 to which the main body 20 is coupled, a user's mouth may come in contact with the mouthpiece 160**, and then the user may inhale so that aerosol is provided to the user.

A pressure difference between the outside of the cartridge 10 and the inside of the cartridge 10 may occur due to an inhalation or puff operation of the user, and because of the pressure difference between the inside and outside of the cartridge 10, the aerosol generated inside the cartridge 10 may be discharged to the outside of the cartridge 10 through the outlet **160*e*. The user may be supplied with aerosol being discharged to the outside of the cartridge 10 through the outlet 160*e* by the user contacting their mouth with the mouthpiece 160** and inhaling.

The storage 200 may be located inside the housing 100 and may accommodate the aerosol generating material. When "the storage accommodates the aerosol generating material therein," the storage 200 functions as a container simply holding an aerosol generating material and that the storage 200 includes therein an element impregnated with (or containing) an aerosol generating material, such as a sponge, cotton, fabric, or porous ceramic structure. Further, the above meaning applies to the description below.

In the storage 200, aerosol generating materials, for example, in any one state among a liquid state, a solid state, a gas state, or a gel state may be accommodated.

According to an embodiment, the aerosol generating material may include a liquid composition. The liquid composition may be a liquid including a tobacco-containing material having a volatile tobacco flavor component, or a liquid including a non-tobacco material.

The liquid composition may include, for example, any one component of water, solvents, ethanol, plant extracts, spices, flavorings, and vitamin mixtures, or a mixture thereof. The spices may include menthol, peppermint, spearmint oil, and various fruit-flavored ingredients, but are not limited thereto.

The flavorings may include ingredients capable of providing various flavors or tastes to a user. The vitamin mixture may include at least one of vitamins A, B, C, and E, but is not limited thereto. Also, the liquid composition may include an aerosol forming substance, such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 1000, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The delivery portion 300 may absorb the aerosol generating material. According to an embodiment, the aerosol generating material stored or accommodated in the storage 200 may be delivered from the storage 200 to the vibrator 400 through the delivery portion 300, and the vibrator 400 may generate aerosol by atomizing the aerosol generating material of the delivery portion 300 or the aerosol generating material delivered from the delivery portion 300. In this case, the delivery portion 300 may include at least one of cotton fibers, ceramic fibers, glass fibers, and porous ceramics, but embodiments of the delivery portion 300 are not limited thereto.

The vibrator 400 may be located inside of the housing 100 and may generate aerosol by converting the phase of the aerosol generating material stored inside the cartridge 10. The vibrator 400 may generate aerosol, for example, by heating or vibrating the aerosol generating material.

According to an embodiment, the vibrator 400 of the aerosol generating device 1000 may convert the phase of the aerosol generating material by using an ultrasonic vibration method that atomizes the aerosol generating material with an ultrasonic vibration.

For example, the vibrator 400 may generate short periods of vibrations, and the vibrations generated from the vibrator 400 may be ultrasonic vibrations. The frequency of the ultrasonic vibrations may be about 100 kHz to about 3.5 MHZ, but is not limited thereto.

The aerosol generating material supplied to the vibrator 400 from the storage 200 by short periods of vibrations generated from the vibrator 400 may be vaporized and/or changed to particles and atomized to an aerosol.

The vibrator 400 may include, for example, a piezoelectric ceramic, and the piezoelectric ceramic may, by generating electricity (voltage) by a physical force (pressure), and generating vibration (mechanical force) when electricity is applied thereto, act as a functional material capable of converting electrical and mechanical forces into one another. That is, as electricity is applied to the vibrator 400, vibrations (physical force) of short periods may be generated, and the generated vibrations may break down the aerosol generating material to small particles to thereby atomize to an aerosol.

The vibrator 400 may be electrically connected to other components of the aerosol generating device 1000 through the electrical terminal 500. The electrical terminal 500 may be located on one side of the cartridge 10. For example, the electrical terminal 500 may be located in the coupling surface of the cartridge 10 where the cartridge 10 is coupled to main body 20 of the aerosol generating device 1000. The electrical terminal 500 may be located on a surface of the housing 100 facing away from the mouthpiece 160.

According to an embodiment, the vibrator 400 may be electrically connected to at least one of a battery 600 and a processor 700 of the main body 20 and a driving circuit of the aerosol generating device 1000 through the electrical terminal 500 located inside the housing 100 of the cartridge 10.

For example, the vibrator 400 may be electrically connected to the electrical terminal 500 located inside the cartridge 10 through a first conductor, and the electrical terminal 500 may be electrically connected to the battery 600 and processor 700 of the main body 20 and/or other driving circuits through a second conductor. That is, the vibrator 400 may be electrically connected to the elements of the main body 20 via the electrical terminal 500.

The vibrator 400 may generate ultrasonic vibration by receiving currents or voltages from the battery 600 of the main body 20 through the electrical terminal 500. In addition, the vibrator 400 may be electrically connected to the processor 700 of the main body 20 through the electrical terminal 500, and the processor 700 may control the operation of the vibrator 400.

The electrical terminal 500 may be, for example, at least one of a Pogo PIN, a wire, a cable, a printed circuit board (PCB), a flexible printed circuit board (FPCB) and a C-clip, but the electrical terminal 500 is not limited to the above examples.

In another embodiment (not shown), the vibrator 400 may be implemented as a mesh shape or plate shape vibration accommodation portion that performs a function of absorbing the aerosol generating material without using a separate delivery portion 300 and maintaining the aerosol generating material in an optimal state for conversion to an aerosol, and a function of transmitting vibration to the aerosol generating material and generating an aerosol.

The aerosol generated by the vibrator 400 may be discharged to the outside of the cartridge 10 through an airflow passage 150 and supplied to the user.

According to an embodiment, the airflow passage 150 may be located inside the cartridge 10 and may be connected to the vibrator 400 and the outlet 160*e* of the mouthpiece 160. Accordingly, the aerosol generated in the vibrator 400 may flow along the airflow passage 150 and may be discharged to the outside of the cartridge 10 or the aerosol generating device 1000 through the outlet 160*e*. The user may be supplied with the aerosol by contacting their mouth with the mouthpiece 160 and inhaling the aerosol being discharged from the outlet 160*c*.

Although not shown in FIG. 1, the airflow passage 150 may include at least one inlet for air outside of the cartridge 10 to flow into the cartridge 10. The inlet may be located in at least a portion of the housing 100 of the cartridge 10. For example, the inlet may be located at the coupling surface (e.g., a bottom) of the cartridge 10 where the cartridge 10 is coupled to the main body 20.

Because at least one gap may be formed in a portion where the cartridge 10 is coupled to the main body 20, external air may flow into the gap between the cartridge 10 and the main body 20 and move into the cartridge 10 through the inlet.

The airflow passage 150 may extend from the inlet to a space where aerosol is generated by the vibrator 400, and may extend from the space to the outlet 160*e*.

Accordingly, the air flown in through the inlet may be transmitted to the vibrator 400, and the transmitted air may move to the outlet 160*e* together with the aerosol generated by the vibrator 400, and thus, airflow may be circulated inside the cartridge 10.

According to an embodiment, an outer circumferential surface of at least a portion of the airflow passage 150 may be surrounded by the storage 200 inside the housing 100. In another example, at least a portion of the airflow passage 150 may be arranged between an inner wall of the housing 100 and an outer wall of the storage 200. The arrangement structure of the airflow passage 150 is not limited to the above example, and the airflow passage 150 may be arranged in various structures in which the airflow is circulated between the inlet, the vibrator 400, and the outlet 160*c*.

The battery 600 and the processor 700 may be included inside the main body 20, and one end of the main body 20 may be coupled to one end of the cartridge 10. For example, the main body 20 may be coupled to the bottom of the coupling surface of the cartridge 10.

The battery 600 may supply power to be used for the aerosol generating device 1000 to operate. For example, when the main body 20 is electrically connected to the cartridge 10, the battery 600 may supply power to the vibrator 400.

Further, the battery 600 may supply power for operations of other hardware components provided inside the aerosol generating device 1000 (e.g., a sensor, a user interface, a memory, and the processor 700). The battery 600 may include a rechargeable battery or a disposable battery.

For example, the battery 600 may include a nickel-based battery (for example, a nickel-metal hydride battery or a nickel-cadmium battery), or a lithium-based battery (for example, a lithium-cobalt battery, a lithium-phosphate battery, a lithium titanate battery, a lithium-ion battery, or a lithium-polymer battery).

The processor 700 may generally control operations of the aerosol generating device 1000. For example, the processor 700 may control power supplied from the battery 600 to the vibrator 400 to control the production amount of the aerosol generated by the vibrator 400. According to an embodiment, the processor 700 may control the current or voltage supplied to the vibrator so that the vibrator 400 may vibrate at a certain frequency.

The processor 700 may be implemented as an array of a plurality of logic gates or as a combination of a general-purpose microprocessor and a memory in which a program executable in the microprocessor is stored, the program configured to cause the microprocessor to perform the functions of the processor 700. It will be understood by one of ordinary skill in the art that the processor 700 may be implemented in other forms of hardware.

The processor 700 may analyze the results sensed by at least one sensor included in the aerosol generating device 1000 and controls the processes to be performed. For example, on the basis of the result sensed by the at least one sensor, the processor 700 may control power supplied to the vibrator 400 so that operation of the vibrator 400 starts or ends. In addition, based on the result sensed by the at least one sensor, the processor 700 may control the amount of power supplied to the vibrator 400 and the time at which the power is supplied so that the vibrator 400 may generate an appropriate amount of aerosol.

According to an embodiment, the cross-sectional shape in a direction transverse to the longitudinal direction of the cartridge 10 and/or the main body 20 of the aerosol generating device 1000 may be circular, elliptical, square, rectangular, or other various types of polygons. However, the cross-sectional shape of the cartridge 10 and/or the main body 20 is not limited to the shape described above, and the aerosol generating device 1000 may not extend in a straight line in the longitudinal direction in some embodiments.

In another embodiment, the cross-sectional shape of the aerosol generating device 1000 may be curved in a streamline shape for the user to comfortably hold the aerosol generating device 1000 or may be bent in a predetermined angle at a certain area and elongated, and the cross-sectional shape of the aerosol generating device 1000 may change along the longitudinal direction.

FIG. 2 is a perspective view of the cartridge and the main body of the aerosol generating device according to another embodiment, separated from each other, and FIG. 3 is a perspective view of the main body and the cartridge of the aerosol generating device according to the embodiment of FIG. 2, coupled to each other. FIG. 4 is a diagram showing an aspect of the cartridge according to the embodiment of FIG. 2, and FIG. 5 is a diagram showing another aspect of the cartridge according to the embodiment of FIG. 2.

The aerosol generating device 1 according to the embodiment shown in FIGS. 2 and 3 may be a modified example of the aerosol generating device 1000 shown in FIG. 1, and the cartridge 10 according to the embodiment shown in FIGS. 2 to 5 may be a modified example of the cartridge 10 shown in FIG. 1. Hereinafter, redundant descriptions are omitted.

Referring to FIGS. 2 and 3, the aerosol generating device 1 according to another embodiment may include the main body 20 and the cartridge 10. The cartridge 10 may be removably coupled to the main body 20. For example, because at least a portion of the cartridge 10 is inserted into the main body 20, the cartridge 10 may be coupled to the main body 20.

The cartridge 10 may include a mouthpiece 10*m* movable between the open position and the closed position. For example, the mouthpiece 10*m* may be opened and closed by rotating between the open position and the closed position.

Referring to FIGS. 4 and 5, a body portion 10*b* of the cartridge 10 may be coupled to the mouthpiece 10*m* through a rotation shaft. According to an aspect, the mouthpiece 10*m* may be located at an open position. The open state of the mouthpiece 10*m* may indicate a state in which the mouthpiece 10*m* is unfolded in a longitudinal direction of the cartridge 10 for the user to easily contact the aerosol generating device to their mouth. Here, the longitudinal direction may indicate the direction in which the cartridge 10 extends the longest among several directions.

In another aspect, the mouthpiece 10*m* may be located in the closed position. The state in which the mouthpiece 10*m* is closed may indicate that the mouthpiece is folded in a direction crossing the longitudinal direction of the cartridge 10 such that the mouthpiece 10*m* may be accommodated in the main body 20 of the aerosol generating device 1.

As another example, the mouthpiece 10*m* may be opened and closed by sliding between the open position and the closed position, but the movement method of the mouthpiece 10*m* is not limited thereto.

The cartridge 10 may include the body portion 10*b* including a variety of components required to generate aerosol and discharge the generated aerosol. Although not shown, the body portion 10*b* may include a part of the storage (not shown), the vibrator (not shown), and the airflow passage (not shown). According to an embodiment, the vibrator may be located outside (e.g., the main body 20) of the cartridge 10.

The main body 20 may include a coupling portion 20*a* to which the cartridge 10 may be coupled. For example, the main body 20 may include an accommodating groove 20*a*-1 in which at least a portion of the cartridge 10 may be accommodated. The body portion 10*b* of the cartridge 10 may be inserted into the accommodating groove 20*a*-1. For example, the body portion 10*b* of the cartridge 10 may be roughly a square pillar shape, and the corners of the square pillar may be chamfered or rounded. However, the shape of the body portion 10*b* of the cartridge 10 is not limited to the above-described example and may be a circular cylinder or a polygonal pillar shape.

As described with respect to FIG. 1, the cartridge 10 may be coupled to the main body 20 by at least one method of a snap-fit method, a screw connection method, a magnetic coupling method, or a forcible fit method. For example, the cartridge 10 may include a first magnetic body, and the main body 20 may include a second magnetic body so that the cartridge 10 may be coupled to the main body 20. The magnetic intensity of the first magnetic body and the second magnetic body may be designed in consideration of case of attachment and detachment of the cartridge 10 and the main body 20 and/or the operational stability of the aerosol generating device 1.

The main body 20 may include a button 20*b*. The button 20*b* may be located on one side of the main body 20. For example, the button 20*b* may be located on one side of the main body 20 corresponding to one end 20*c*-1 of a cover 20*c*. The user may manipulate the operation of the aerosol generating device 1 by using the button 20*b* when using the aerosol generating device 1.

The main body 20 may further include an accommodation unit 20*s* that may accommodate the mouthpiece 10*m* when the mouthpiece 10*m* of the cartridge 10 is moved to the closed position. The accommodation unit 20*s* may be located on a surface of the main body 20 and may correspond to the mouthpiece 10*m* in size and shape.

As shown in FIG. 3, the portability of the aerosol generating device 1 may be improved because a portion of the mouthpiece 10*m* protruding from the closed position to the outside of the aerosol generating device 1, that is, the portion protruding from the outer surface of the main body 20 to the outside, may be minimized.

According to an embodiment, the main body 20 may further include the cover 20*c* that is coupled to a portion of the main body 20. The cover 20C may be coupled to at least one surface of the main body 20. For example, the cover 20*c* may be coupled to a side of the main body 20 where the coupling portion 20*a* is located. In addition, the cover 20*c* may be coupled to a side of the main body 20 where the accommodation unit 20*s* is located.

The cover 20*c* may include an opening 20*c*-*o*. The cover 20*c* may have an opening 20*c*-*o* may correspond to the mouthpiece 10*m* in size. For example, the opening 20*c*-*o* may have a certain length and width. Here, the width of the opening 20*c*-*o* may be less than or equal to the width of the body portion 10*b* of the cartridge 10, and may be greater than or equal to the width of the mouthpiece 10*m*. The length of the opening 20*c*-*o* may be greater than or equal to the length of the mouthpiece 10*m*.

The cover 20*c* may extend from an end 20*c*-1 to another end 20*c*-2 and may be placed in a seating portion 20*c*' of the main body 20. For example, the seating portion 20*c*' may correspond to the cover 20*c* in size and shape. The seating portion 20*c*' may extend in both directions of the opening portion of the coupling portion 20*a* and the accommodation unit 20*s* and may be concave in a certain depth such that the cover 20*c* may be coupled to the seating portion 20*c*'.

After the cartridge 10 is coupled to the main body 20, the cover 20*c* may be coupled to the main body 20. The cover 20*c* may be coupled to a side of the main body 20 by at least one method of a snap-fit method, a forcible fit method, or a magnetic coupling method, but is not limited thereto.

Because the cover 20*c* includes the opening 20*c*-*o* through which the mouthpiece 10*m* may pass, the cover 20*c* may protect the cartridge 10 without disturbing the opening and closing movement of the mouthpiece 10*m* of the in a state in which the cartridge 10 is coupled to the main body 20 and may maintain the state in which the cartridge 10 is coupled to the main body 20.

FIG. 3 shows an aerosol generating device 1 in which the cartridge 10 and the cover 20*c* is coupled to the main body 20 and the mouthpiece 10*m* is located at the closed position. As shown, because the main body 20 includes the accommodation unit 20*s* corresponding to the mouthpiece 10*m* in size and shape and the seating portion 20*c*' corresponding to the cover 20*c* in size and shape, and the cover 20*c* includes the opening 20*c*-*o* corresponding to the mouthpiece 10*m* in size and shape, the aerosol generating device 1 may be solidly and elegantly finished overall.

After the cartridge 10 is separated from the main body 20, the cartridge 10 may be separated from the main body 20. In this regard, the cover 20*c* and the cartridge 10 may be sequentially separated from the main body 20 or may be sequentially coupled to the main body 20.

FIG. 6 is a cross-sectional view of the aerosol generating device of the embodiment of FIG. 2, and FIG. 7 is an exploded perspective view of the cartridge for the embodiment of FIG. 2.

The aerosol generating device 1 shown in FIG. 7 may be the aerosol generating device 1 shown in FIG. 2 or a modified example, and the cartridge 10 of the embodiment shown in FIGS. 6 and 7 may be the cartridge 10 of the aerosol generating device 1 shown in FIG. 2 or a modified example. Hereinafter, overlapping descriptions are omitted.

Referring to FIGS. 6 and 7, the aerosol generating device 1 according to another embodiment may include the cartridge 10 and the main body 20. The cartridge 10 according to an embodiment may include the mouthpiece 10*m* and the body portion 10*b*, and the main body 20 according to an embodiment may include the coupling portion 20*a* and a holding portion 20*m*.

The body portion 10*b* may include the housing 100, the storage 200, the delivery portion 300, the vibrator 400, and a first airflow passage 150-1, and the mouthpiece 10*m* may include a second airflow passage 150-2.

The mouthpiece 10*m* may be coupled or connected to the body portion 10*b* to be movable with respect to the body portion 10*b*. The components of the cartridge 10 according to an embodiment are not limited to the examples described above, and elements may be added or some elements may be omitted.

The housing 100 may form the overall outer shape of the cartridge 10, and form an inner space in which the components of the cartridge 10 may be arranged. Although embodiments in which the overall shape of the housing 100 of the cartridge 10 is a square column were illustrated in the drawings, the shape of the housing 100 is not limited thereto. In another embodiment (not shown), the housing 100 may be formed in a cylindrical shape, or a polygonal column (e.g., a triangular column, a pentagonal column) shape other than a square column, overall.

According to one embodiment, the housing 100 may include a first housing 110, a second housing 120 connected to an area of the first housing 110, and a third housing 130 connected to another area of the first housing 110.

For example, the second housing 120 may be coupled to an area located in the lower end (e.g. −z direction) of the first housing 110, and an inner space in which the components of the cartridge 10 may be located may be formed between the first housing 110 and the second housing 120.

The third housing 130 may be coupled to an area located at the upper end (e.g. +2 direction) of the first housing 110 and at least a portion of the mouthpiece 10*m* may be disposed on a side of the third housing 130.

In the disclosure, "upper end" may refer to the "+z" direction of FIGS. 6 and 7, and "lower end" may refer to the opposite direction, the "−z" direction of FIGS. 6 and 7, and the expressions may have such meaning here below.

The first housing 110 and the second housing 120 may, by being coupled to each other, form the first airflow passage 150-1 in which airflow (e.g., air, aerosol) moves inside the body portion 10*b*. For example, the first housing 110 may form a portion of the first airflow passage 150-1, and the second housing 120 may form the rest of the first airflow passage 150-1.

In addition, the first housing 110 and the second housing 120 may be coupled to each other to form an inner space, and a variety of components such as the vibrator 400, the delivery portion 300, a circuit board 520, etc. used for the operation of cartridge 10 may be accommodated or arranged in the inner space.

The first housing 110 and the second housing 120 may protect the components accommodated in the inner space, and the third housing 130 may protect the mouthpiece 10*m* and other components that are coupled or connected to the mouthpiece 10*m*.

The housing 100 may include at least one inlet 10*i* through which external air may be introduced into the cartridge 10. When the user puts his/her mouth to the mouthpiece 10*m* and inhales, the pressure inside the cartridge 10 may become lower than the atmospheric pressure, and the external air may be introduced into the cartridge 10 through the inlet 10*i*.

The housing 100 may form at least a portion of the first airflow passage 150-1, or some structure of the housing 100 may function as an inner wall of the first airflow passage 150-1. For example, the first housing 110 may be in communication with the vibrator 400, and may include an atomizing space 400*c* from which aerosol is generated and a connector 110*c* connecting the body portion 10*b* and the mouthpiece 10*m*. The atomizing space 400*c* may be located at a center of the first housing 110, and the connector 110*c* may be located on the top surface of the first housing 110 where the first housing 110 is coupled to the third housing 130.

According to an embodiment, the second housing 120 may include the inlet 10*i*. The inlet 10*i* may be formed in at least a portion of the second housing 120. For example, the inlet 10*i* may be located at the bottom surface of the second housing 120 where the cartridge 10 is coupled to the main body 20.

The mouthpiece 10*m* is where the user's mouth may be in contact, and the mouthpiece 10*m* may be placed or coupled to an area of the housing 100. For example, the mouthpiece 10*m* may be connected to the third housing 130.

The mouthpiece 10*m* may move between the open position and the closed position. The cartridge 10 may further comprise a first elastic body 10*m*-1 that provides elastic force to the mouthpiece 10*m*. For example, the first clastic body 10*m*-1 may elastically support the mouthpiece 10*m* toward the open position.

The first elastic body 10*m*-1 may be located around the rotation shaft of the mouthpiece 10*m*. The mouthpiece 10*m* may move from the closed position to the open position by the elastic force of the first elastic body 10*m*-1. The first elastic body 10*m*-1 may be made of a metal material (e.g., SUS).

According to an embodiment, the mouthpiece 10*m* may rotate around the rotation shaft, and the first elastic body 10*m*-1 may be a torsion spring located at the rotation shaft of the mouthpiece 10*m*. The deformation of the first elastic body 10*m*-1 may be relatively large when the mouthpiece 10*m* is in the closed position, and the deformation of the first elastic body 10*m*-1 may be relatively small when the mouthpiece 10*m* is in the open position. Accordingly, the mouthpiece 10*m* may have elasticity biased in a direction such that the mouthpiece 10*m* opens from the closed position to the open position.

The mouthpiece 10*m* may include the second airflow passage 150-2 for discharging the aerosol generated from the inside of the cartridge 10 to the outside of the cartridge 10. For example, one side (e.g., an outlet 10*c*) of the second airflow passage 150-2 may be connected to the outside and the other side of the second airflow passage 150-2 may be connected to the first airflow passage 150-1 in the open position. The user may put his/her mouth to the mouthpiece 10*m* and be provided with the aerosol that is discharged to the outside through the outlet 10*e* of the mouthpiece 10*m*.

According to an embodiment, the mouthpiece 10*m* may be rotatably coupled to the third housing 130 together with a support portion 10*m*-2. The support portion 10*m*-2 may be located between the mouthpiece 10*m* and the third housing 130, and may cover at least a portion of the other side of the mouthpiece 10*m*.

The mouthpiece 10*m*, the support portion 10*m*-2, and the third housing 130 may be connected to each other by the rotation shaft. Accordingly, the mouthpiece 10*m* may not only be firmly coupled to the third housing 130, but is also rotatable with respect to the third housing 130 and thus, may move between the open position and the closed position.

The mouthpiece 10*m* may be held in the closed position by the holding portion 20*m* of the main body 20. Details of the holding portion 20*m* are described below.

The aerosol generated by the vibrator 400 may be discharged to the outside of the cartridge 10 through the airflow passage 150 and supplied to the user. For example, aerosol generated by the vibrator 400 may flow along the airflow passage 150 that connects or puts the atomizing space 400*c* to or in communication with the outlet 10*c* of the mouthpiece 10*m*, and may be discharged to the outside of the cartridge 10 through the outlet 10*c*.

According to an embodiment, the airflow passage 150 may extend along the inlet 10*i*, the atomizing space 400*c* in which aerosol is generated, and the outlet 10*c*. The airflow passage 150 may be formed by at least one component (e.g., the first housing 110, the second housing 120, and the mouthpiece 10*m*) of the cartridge 10. Alternatively, a change may be made to the above configuration so that at least a portion of the airflow passage 150 may be formed by a tube inserted into the housing 100.

Air may pass through the atomizing space 400*c* from the inlet 10*i* and flow in a forward direction towards the outlet 10*e*. Herein, "forward direction" may indicate the direction of the airflow when the user inhales the mouthpiece 10*m*. For example, the forward direction may indicate a direction towards the atomizing space 400*c* from the inlet 10*i* and a direction towards the outlet 10*e* from the atomizing space 400*c*.

According to an embodiment, the airflow passage 150 may include the first airflow passage 150-1 which is connected from the inlet 10*i* through the atomizing space 400*c* to the connector 110*c* to which the body portion 10*b* and the mouthpiece 10*m* are connected, and a second airflow passage 150-2 located inside the mouthpiece 10*m*.

The first airflow passage 150-1 may be connected from the inlet 10*i* through the inner structure of the first housing 110 and the second housing 120 to the connector 110*c*. For example, the airflow moving in the forward direction along the first airflow passage 150-1 may move in the +z direction, a direction across the z axis, the −z direction, the direction across the z axis, and the +z direction, sequentially.

Referring to FIG. 6, the first airflow passage 150-1 may indicate a space in which external air flows into the cartridge 10 through the inlet 10*i*, flows into the atomizing space 400*c*, and flows together with the aerosol to the connector 110*c*. According to the example above, the first airflow passage 150-1 may roughly have a zig-zag shape.

The airflow flowing in the first airflow passage 150-1 may form a sudden curve in a portion where the flowing direction changes. For example, the flowing path of the airflow may be suddenly changed in a portion where the atomizing space 400*c* is placed. For this reason, the time the airflow stays in the atomizing space 400*c* and the possibility of occurrence of eddy currents may increase. As a result, the external air that flows into the atomizing space 400*c* and the generated aerosol may be more easily mixed.

The second airflow passage 150-2 may indicate the internal passage of the mouthpiece 10*m*. The second airflow passage 150-2 may be connected to the connector 110*c* when the mouthpiece 10*m* is in the open position. The second airflow passage 150-2 may be disconnected from the connector 110*c* when the mouthpiece 10*m* is in the closed position.

The storage 200 may be arranged in the inner space of the first housing 110, and the aerosol generating material may be stored in the storage 200. For example, a liquid aerosol generating material may be stored in the storage 200, but embodiments are not limited thereto.

The delivery portion 300 may be located between the storage 200 and the vibrator 400, and the aerosol generating material stored in the storage 200 may be supplied to the vibrator 400 through the delivery portion 300.

According to an embodiment, the delivery portion 300 may receive the aerosol generating material from the storage 200, and may deliver the received aerosol generating material to the vibrator 400. For example, the delivery portion 300 may absorb the aerosol generating material of the storage 200, and the aerosol generating material absorbed by the delivery portion 300 may be delivered to the vibrator 400.

The delivery portion 300 may be arranged adjacent to the storage 200 to receive the liquid aerosol generating material from the storage 200. For example, aerosol generating material stored in the storage 200 may be discharged to the outside of the storage 200 through a liquid supply port (not shown) that is formed in an area facing the delivery portion 300 from the storage 200, and the delivery portion 300 may absorb at least some of the aerosol generating material discharged from the storage 200, thereby absorbing the aerosol generating material from the storage 200.

According to an embodiment, the cartridge 10 may be arranged to cover at least a portion of the vibrator 400 in which the aerosol is generated, and may further include an absorbent 320 that delivers the aerosol generating material absorbed by the delivery portion 300 to the vibrator 400.

The absorbent 320 may be manufactured with a material that can absorb aerosol generating materials. For example, the absorbent 320 may include at least one material from among SPL 30 (H), SPL 50 (H) V, NP 100 (V8), SPL 60 (FC), and melamine.

Because the absorbent 320 is further included in the cartridge 10, the aerosol generating material may be absorbed not only in the delivery portion 300 but also in the absorbent 320, thereby improving the aerosol generating material absorption amount.

Here, the delivery portion 300 may include a material having a higher aerosol generating material absorption rate compared to that of the absorbent 320. When the delivery portion 300 has a higher absorption rate compared to that of the absorbent 320, the aerosol generating material delivered to the absorbent 320 by the delivery portion 300 may be adjusted, by the absorbent 320 having a relatively lower absorbent rate, to be supplied at a uniform rate to the vibrator 400. Accordingly, too much aerosol generating materials may be prevented from coming in contact with the vibrator 400.

In addition, because the absorbent 320 is arranged to cover at least a portion of the vibrator 400, the absorbent 320 may act as a physical barrier that prevents a "splash of droplets," which is a direct discharging of particles that are not sufficiently atomized in the process of generating aerosol to the outside of the aerosol generating device 1. Herein, the "splash of droplets" may mean that particles of aerosol generating materials that are relatively greater in size due to not having not been sufficiently atomized are discharged to the outside of the cartridge 10. Because the absorbent 320 is further included in the cartridge 10, the likelihood of the splashing of droplets may be reduced and thus, the smoking satisfaction of the user may be improved.

According to an embodiment, the absorbent 320 may be located between a surface of the vibrator 400 in which the aerosol is generated and the delivery portion 300, thereby delivering the aerosol supplied to the delivery portion 300 to the vibrator 400. For example, an area of the absorbent 320 may be in contact with an area facing the −z direction of the delivery portion 300, and the other region of the absorbent 320 may be in contact with an area facing the +z direction of the vibrator 400. Thus, the absorbent 320 may be located at the top surface (e.g., +z direction) of the vibrator 400, and may supply the aerosol generating material absorbed by the delivery portion 300 to the vibrator 400.

The delivery portion 300, the absorbent 320, and the vibrator 400 may be disposed sequentially along the longitudinal direction (e.g., z axis direction) of the cartridge 10 or the housing 100, and, as a result, the absorbent 320 and the delivery portion 300 may be sequentially stacked on the vibrator 400.

Through the arrangement structure described above, at least some of the aerosol generating material supplied from the storage 200 to the delivery portion 300 may be moved to the absorbent 320 in contact with the delivery portion 300, and the aerosol generating material moved to the absorbent 320 may move along the absorbent 320 to reach an area adjacent to the vibrator 400. Accordingly, the aerosol generating material is stably delivered to the vibrator 400, and thus, a uniform amount of aerosol may be generated continuously, and a physical double barrier that prevents the splash of droplets may be implemented through the arrangement structure described above.

The drawings show embodiments in which only one delivery portion 300 and one absorbent 320 are included, but the cartridge 10 according to another embodiment may include a plurality of the delivery portion 300 and/or a plurality of the absorbent 320.

The vibrator 400 may atomize the liquid aerosol generating material supplied from the delivery portion 300 to generate an aerosol.

For example, the vibrator 400 may include a vibrator that generates ultrasonic vibration. The frequency of ultrasonic vibration generated in the vibrator may be about 100 kHz to about 10 MHZ, for example, about 100 kHz to about 3.5 MHZ. As the vibrator generates ultrasonic vibration in the frequency band described above, the vibrator may vibrate along the longitudinal direction (e.g., z axis direction) of the cartridge 10 or the housing 100. However, embodiments are not limited to the direction in which the vibrator vibrates, and the direction in which the vibrator vibrates may be changed to various directions (e.g., any one of the x axis direction, y axis direction, z axis direction, or a combination of the directions).

By atomizing the aerosol generating material through an ultrasonic vibration method, the vibrator 400 may generate an aerosol at a relatively low temperature compared to when the aerosol generating material is heated. For example, in the case of heating the aerosol generating material by using the heater, a situation in which the aerosol generating material is heated to a temperature of 200° C. or more may occur, causing the user to feel a burnt taste in the aerosol.

On the other hand, the cartridge 10 according to an embodiment may generate aerosol in a temperature range of about 100° C. to about 160° C., which is a temperature lower than when the aerosol generating material is heated with the heater, by atomizing the aerosol generating material through the ultrasonic vibration method. Accordingly, the burnt taste in the aerosol may be minimized, thereby improving the smoking satisfaction of the user.

The vibrator 400 may be electrically connected to an external power through the circuit board 520, and may generate ultrasonic vibration by the power supplied from the external power. For example, the vibrator 400 may be electrically connected to the circuit board 520 located inside the cartridge 10, and the circuit board 520 may be electrically connected to the main body 20, and thus, the vibrator 400 may be supplied with power from the battery 600.

Aerosol may be generated in the atomizing space 400*c* located on a surface of the vibrator 400 and in communication with the airflow passage 150. When the user inhales through the open mouthpiece 10*m*, the aerosol generated in the atomizing space 400*c* may be mixed with the external air that flows in along the airflow passage 150 and moves toward the outlet 10*e*.

In an example, the atomizing space 400*c* may be located at a surface of the vibrator 400 facing the connector 110*c*, and the atomizing space 400*c* may be in communication with the airflow passage 150 at the upper end of the vibrator 400. Accordingly, because the cartridge 10 has a straight aerosol discharging path, the generated aerosol may easily be discharged to the outside of the cartridge 10.

According to an embodiment, the vibrator 400 may be electrically connected to the circuit board 520 through a first conductor 410 and a second conductor 420.

According to an embodiment, the first conductor 410 may include a material (e.g., metal) having electrical conductivity, and may be located at the upper end of the vibrator 400, thereby electrically connecting the vibrator 400 and the circuit board 520.

For example, a portion of the first conductor 410 (e.g., the upper end portion) may be arranged to cover at least an area of the outer circumferential surface of the vibrator 400 to be in contact with the vibrator 400, and another portion (e.g., the lower end portion) of the first conductor 410 may be formed to extend from a portion toward a direction of the circuit board 520 to be in contact with an area of the circuit board 520. The vibrator 400 and the circuit board 520 may be electrically connected by the contact structure of the first conductor 410 described above.

For example, because an opening 410*h* is formed on a portion of the first conductor 410, at least a portion of the vibrator 400 may be exposed to the outside of the first conductor 410. An area of the vibrator 400 exposed to the outside of the first conductor 410 through the opening 410*h* of the first conductor 410 may be in contact with the delivery portion 300 and/or the absorbent 320 to atomize the aerosol generating material contained in the delivery portion 300 and/or the absorbent 320.

According to an embodiment, the second conductor 420 may include a material having electrical conductivity, and may be located at the lower end of the vibrator 400 or between the vibrator 400 and the circuit board 520, thereby electrically connecting the vibrator 400 and the circuit board 520. For example, one end of the second conductor 420 may be in contact with the lower end portion of the vibrator 400, and another end of the second conductor 420 may be in contact with an area of the circuit board 520 facing the vibrator 400, thereby electrically connecting the vibrator 400 and the circuit board 520.

According to an embodiment, the second conductor 420 may include a conductive material having an elasticity, thereby electrically connecting the vibrator 400 to the circuit board 520, in addition to elastically supporting the vibrator 400. For example, the second conductor 420 may include a conductive spring, but the second conductor 420 is not limited to the embodiment described above.

The cartridge 10 according to an embodiment may include a support 430 located between the vibrator 400 and the circuit board 520, thereby supporting the second conductor 420. The support 430 may include, for example, an elastic material (e.g., silicon and rubber), and may be arranged to cover the outer circumferential surface of the second conductor 420 to elastically support the second conductor 420.

According to an embodiment, the circuit board 520 may be located inside the second housing 120 and may be electrically connected to the vibrator 400 through the first conductor 410 and the second conductor 420. At the same time, the circuit board 520 may be electrically connected to the main body 20 through a connection terminal 20*a*-2 located in the main body 20 of the aerosol generating device 1.

The circuit board 520 may be electrically connected to the vibrator 400 by the first conductor 410 and the second conductor 420, and may be electrically connected to the battery 600 of the main body 20 through the connection terminal 20*a*-2, and thus, the vibrator 400 may be electrically connected to the external power of the cartridge 10 through the circuit board 520 to be supplied with power.

According to an embodiment, the second housing 120 may include a through hole 120*h* penetrating through the inside of the second housing 120 and the outside of the cartridge 10, and the connection terminal 20*a*-2 of the main body 20 of the aerosol generating device 1 may be connected to the second housing 120 through the through hole 120*h*, thereby electrically connecting the circuit board 520 located inside the cartridge 10 and the battery 600 of the main body 20.

The cartridge 10 may further include a support plate 510 for grounding the circuit board 520 or firmly coupling the circuit board 520 to the second housing 120. The support plate 510 may be located between the second housing 120 and the circuit board 520 to reinforce the coupling between the circuit board 520 and the second housing 120. In addition, the support plate 510 may include hole corresponding to the through hole 120*h* such that the connection terminal 20*a*-2 of the main body 20 may be connected to the inside of the cartridge 10.

When power starts to be supplied to the vibrator 400, or during the process of supplying power to the vibrator 400, noise may unintentionally occur in an electrical circuit between the vibrator 400 and the external power source. For example, a higher voltage than a designated value may be applied to the vibrator 400 due to the generation of noise in the voltage signal provided to the vibrator 400, and thus, the temperature of the vibrator 400 may rise sharply (e.g., rise above the Curie temperature), thereby damaging the vibrator 400.

According to an embodiment, the cartridge 10 may further include a resistor R for removing the noise included in the signal applied to the vibrator 400. For example, the resistor R for removing or filtering the noise generated in the process of supplying power from the external power to the vibrator 400 may be arranged in an area of the circuit board 520.

The circuit board 520 may be a printed circuit board, and the resistor R may be mounted in an area of the printed circuit board. Accordingly, the resistor R may remove the noise generated when the aerosol generating device 1 operates (or "power on"), thereby allowing a stable voltage to be applied to the vibrator 400.

Herein, "the resistor R is mounted on an area of the printed circuit board" may refer to, for example, a surface mount method in which the resistor R is electrically connected to the circuit board 520 in such a way that it protrudes from the surface of the circuit board 520, or to a method in which the resistor R is installed such that at least a portion of the resistor R is buried in a surface of the circuit board 520.

The cartridge 10 according to an embodiment may remove or filter the noise generated from the electrical circuit formed between the vibrator 400 and the external power through the resistor R, and as a result, the cartridge 10 or the aerosol generating device 1 may operate stably.

According to an embodiment, the resistor R may form a feedback circuit connected in parallel to the vibrator 400. The resistor R may allow a stable voltage to be applied to the vibrator 400 by removing the noise included in the voltage signal applied to the vibrator 400 by forming the feedback circuit. As a result, damage to the vibrator 400 due to the noise may be prevented, thereby enabling a stable operation of the cartridge 10 or the aerosol generating device 1.

According to an embodiment, the circuit board 520 may be arranged inside the cartridge 10 to be adjacent to the vibrator 400, and the resistor R may be arranged or mounted on a first surface of the circuit board 520 facing the vibrator 400.

When the resistor R for removing the noise included in the voltage signal applied to the vibrator 400 is arranged on a second surface of the circuit board 520, or on the main body 20 instead of the cartridge 10, the electrical length of the feedback circuit may increase.

When the electrical length of the feedback circuit increases, noise may additionally occur during a feedback process of the voltage signal applied to the vibrator 400, and thus, a voltage signal including the noise may be applied to the vibrator 400 even when the feedback circuit is formed.

On the other hand, in the cartridge 10 according to an embodiment, because the circuit board 520 is arranged within a designated distance from the vibrator 400, and the resistor R forming the feedback circuit is arranged on the top surface of the circuit board 520 adjacent to the vibrator 400, the electrical length of the feedback circuit may decrease. Here, "the designated distance between the circuit board 520 and the vibrator 400" may refer to a distance to prevent noise from occurring during the feedback process of the voltage signal.

As a result, a stable voltage signal may be provided to the vibrator 400 by preventing additional noise from occurring during a feedback process of the voltage signal applied to the vibrator 400.

Thus, in the cartridge 10 according to an embodiment, because the resistor R is arranged inside the cartridge 10 instead of the main body 20, stable voltage may be provided to the vibrator 400, and as a result, prevention of damage to the vibrator 400 and a stable operation of the cartridge 10 or aerosol generating device 1 may be guaranteed.

The resistor R may be formed to have a resistance value of about 0.8 MΩ to about 1.2 MΩ to eliminate noise included in the voltage signal applied to the vibrator 400. However, the resistance value of the resistor R may be altered according to the embodiment.

In a comparative embodiment, when at least a portion of the airflow passage 150 is arranged to be covered by the storage 200, the aerosol generating material being leaked from the storage 200 may flow into the airflow passage 150, thereby decreasing the smoking satisfaction of the user.

The cartridge 10 according to an embodiment may further include a hollow portion 210 for preventing the aerosol generating material from leaking from the storage 200 and flowing into the airflow passage 150.

The hollow portion 210 may seal the gaps around the liquid supply port of the storage 200 (e.g., a gap between the liquid supply port and the delivery portion 300). Accordingly, because the hollow portion 210 blocks the aerosol generating material of the storage 200 from leaking into the airflow passage 150 in the cartridge 10 according to an embodiment, the smoking satisfaction of the user may be prevented from decreasing.

According to an embodiment, the hollow portion 210 may be located in the atomizing space 400*c* of the housing 100 to prevent the aerosol generating material of the storage 200 from leaking into the airflow passage 150. For example, the hollow portion 210 may have a circular hollow shape. The hollow portion 210 may be fitted inside the first housing 110 and may be in close contact with the outer wall of the storage 200 and the inner wall of the first airflow passage 150-1.

Because the hollow portion 210 has a passage portion therein, the aerosol generating material may be prevented from flowing into of the airflow passage 150 from the storage 200 and, at the same time, the hollow portion 210 may form a portion of the airflow passage 150 in which aerosol generated from the vibrator 400 moves.

According to an embodiment, the hollow portion 210 may include a plurality of holes connected to the first airflow passage 150-1. For example, the hollow portion 210 may include a first hole 211 and a second hole 212 on a top surface of the hollow portion 210.

The first hole 211 of the hollow portion 210 located inside the first housing 110 may be connected to the first airflow passage 150-1. For example, the first hole 211 may be formed at a position adjacent to the outer wall of the storage 200 in the hollow portion 210, and the external air flowing in the first airflow passage 150-1 in the −z direction may move to the atomizing space 400*c* through the first hole 211.

The second hole 212 may be formed such that the aerosol generated in the atomizing space 400*c* may move to the connector 110*c*. For example, the second hole 212 may be formed in a portion of the hollow portion 210 in which the atomizing space 400*c* faces the connector 110*c*, and thus, the aerosol generated from the atomizing space 400*c* and flowing in the +2 direction may move toward the mouthpiece 10*m* through the second hole 212.

The external air flowing into the airflow passage 150 may move to the atomizing space 400*c* through the first hole 211, and may change its path in the atomizing space 400*c* and move to the outside of the cartridge 10 through the second hole 212.

The hollow portion 210 may include an elastic material (e.g., rubber) and thus may absorb the ultrasound vibration generated in the vibrator 400. Accordingly, the phenomenon in which the ultrasonic vibration generated by the vibrator 400 is delivered to the user through the housing 100 of the cartridge 10 may be minimized.

The hollow portion 210 may maintain a contact between the delivery portion 300 and the vibrator 400 by being located at the upper end of the delivery portion 300 and pressing in a direction toward the vibrator 400. For example, the hollow portion 210 may maintain a contact between the absorbent 320 and the vibrator 400 by pressing the delivery portion 300 and/or the absorbent 320 in the −z direction.

The cartridge 10 according to an embodiment may further include a first waterproof body 330 for maintaining the delivery portion 300 and/or the vibrator 400 inside the first housing 110.

The first waterproof body 330 may arranged to cover at least a portion of the outer circumferential surface of the delivery portion 300, the absorbent 320, and/or the vibrator 400, thereby accommodating the delivery portion 300, the absorbent 320, and/or vibrator 400.

According to an embodiment, the first waterproof body 330 may be disposed between the first housing 110 and the second housing 120. Accordingly, the delivery portion 300, the absorbent 320, and/or the vibrator 400 may be maintained or fixed to an area between the first housing 110 and the second housing 120.

The first waterproof body 330 may be coupled to the first housing 110 such that at least a portion of the first waterproof body 330 is forcibly fit to the first housing 110, but the method of coupling the first housing 110 to the first waterproof body 330 is not limited thereto. In another example, the first housing 110 may be coupled to the first waterproof body 330 by at least one of a snap-fit method, a screw connection method, or a magnetic force coupling method.

According to an embodiment, the first waterproof body 330 may include a material having a certain rigidity and waterproofness (e.g., rubber), and may not only fix the delivery portion 300 and the vibrator 400 to the first housing 110, but also prevent the aerosol generating material from leaking from the storage 200. For example, because the storage 200 seals an area adjacent to the delivery portion 300 or the vibrator 400, the first waterproof body 330 may prevent the leakage of the aerosol generating material.

In addition, the first waterproof body 330 may include an elastic material (e.g., a rubber) like the hollow portion 210 and thus absorb the ultrasonic vibration generated in the vibrator 400.

According to an embodiment, the cartridge 10 may maintain a bond between the first housing 110 and the second housing 120 and further include an O-ring 115 for scaling a space between the first housing 110 and the second housing 120.

For example, the O-ring 115 may be located between the first housing 110 and the second housing 120, and may fill a gap where the first housing 110 is coupled to the second housing 120. Accordingly, the external air of the cartridge 10 may be prevented from flowing into the cartridge 10 through other parts other than the inlet 10*i*.

The O-ring 115 includes a material having a certain elasticity (e.g., silicone) to closely seal a space between the first housing 110 and the second housing 120.

According to an embodiment, the cartridge 10 may further comprise a first scaling body 141 for maintaining the bond between the first housing 110 and the third housing 130 and sealing the storage 200.

The first sealing body 141 may be arranged between the first housing 110 and the third housing 130. For example, the first sealing body 141 may be coupled to the upper end of the first housing 110 and coupled to the lower end of the third housing 130 to thereby maintain a firm bond between the first housing 110 and the third housing 130.

In addition, the first sealing body 141 may include a structure in which the storage 200 is sealed while the first airflow passage 150-1 is not sealed. For example, the first sealing body 141 may be coupled to the upper end of the first housing 110 and have a structure in which a hole is included in a portion where the first airflow passage 150-1 is located and a hole is not included in a portion where the storage 200 is located. Accordingly, the first sealing body 141 may separate the storage 200 and the first airflow passage 150-1 in the upper end of the first housing 110, while not blocking the first airflow passage 150-1.

The cartridge 10 may further include a second sealing body 142 that is coupled to the third housing 130 and seals the surrounding of the connector 110*c*. The second sealing body 142 may be coupled to the upper end of the third housing 130. The second scaling body 142 may include a hole having a size corresponding to the hole of the connector 110*c*, thereby sealing the surrounding of the portion where the first airflow passage 150-1 is connected to the second airflow passage 150-2 while not blocking the connector 110*c*.

The cartridge 10 may include both the first sealing body 141 and the second sealing body 142. The first sealing body 141 and the second sealing body 142 may be coupled to the lower end and the upper end of the third housing 130, respectively, and at least a portion of the first sealing body 141 and the second sealing body 142 may be partially coupled to each other inside the third housing 130. Accordingly, the first housing 110 may be more firmly coupled to the third housing 130 via the first sealing body 141 and the second scaling body 142.

Although the first sealing body 141 and the second sealing body 142 may be coupled to the first housing 110 and/or the third housing 130 through forcible fixing, the coupling method of the first sealing body 141 and the second sealing body 142 is not limited to the embodiment described above.

The first sealing body 141 and the second sealing body 142 may include a material having a certain rigidity and waterproofness (e.g., silicon), may be firmly coupled to the first housing 110 and/or the third housing 130, and may function as a portion of the inner wall of the first airflow passage 150-1.

In a comparative embodiment, In the process of atomizing the aerosol generating material by the vibrator 400, some of the aerosol generating material may not be sufficiently atomized, and thus, droplets with relatively large particles may be generated. In addition, some of the atomized aerosol may be liquefied inside the airflow passage to produce droplets. The generated droplets may block the airflow passage 150, be leaked to the outside of the cartridge 10 through the inlet 10*i*, or be leaked to the outside of the mouthpiece 10*m* through the outlet 10*e*, thereby decreasing the convenience and smoking satisfaction of the user.

The main body 20 according to an embodiment may include a coupling portion 20*a* and a holding portion 20*m*. The cartridge 10 may be removably coupled to the main body 20, and the coupling portion 20*a* may be part of the main body 20 to which the cartridge 10 is coupled. The holding portion 20*m* may maintain or fix the mouthpiece 10*m* located at the closed position.

The coupling portion 20*a* may accommodate at least a portion of the cartridge 10. For example, the coupling portion 20*a* may include an accommodating groove 20*a*-1 corresponding to the body portion 10*b* in shape so that the body portion 10*b* of the cartridge 10 may be accommodated or inserted in the coupling portion 20*a*. The cartridge 10 inserted into the accommodating groove 20*a*-1 may be coupled to the main body 20 by various coupling methods described above.

According to an embodiment, at least an area of the body portion 10*b* of the cartridge 10 may include a first magnetic body (not shown), and at least an area of the coupling portion 20*a* of the main body 20 may include a second magnetic body (not shown). For example, the first magnetic body may be arranged at the lower end of the body portion 10*b*, and the second magnetic body may be arranged at the bottom of the coupling portion 20*a* of the main body 20 that faces the lower end of the inserted body portion 10*b*. Accordingly, the cartridge 10 inserted to a certain position of the accommodating groove 20*a*-1 may be coupled to the accommodating groove 20*a*-1 by magnetic force.

According to an embodiment, the coupling portion 20*a* may include a connection terminal 20*a*-2 for electrically connecting the main body 20 and the cartridge 10. The connection terminal 20*a*-2 may be, for example, at least one of a Pogo PIN, a wire, a cable, a printed circuit board (PCB), a flexible printed circuit board (FPCB), and a C-clip, but the connection terminal 20*a*-2 is not limited to the above examples.

As described above, the connection terminal 20*a*-2 may be connected to the inside of the body portion 10*b* of the cartridge 10 through the through hole 120*h* of the cartridge 10, and may be connected to the circuit board 520 of the cartridge 10. Because the circuit board 520 of the cartridge 10 is electrically connected to the vibrator 400, the vibrator 400 may be electrically connected to the main body 20 by the connection between the connection terminal 20*a*-2 and the circuit board 520. Accordingly, the vibrator 400 may receive power from the battery 600 of the main body 20.

The aerosol generating device 1 may further include an inhalation detecting sensor S. The inhalation detecting sensor S may detect the pressure change or the flow of air inside the aerosol generating device 1, thereby sensing whether the user puffs the aerosol generating device 1.

The inhalation detecting sensor S may be located in any position of the cartridge 10 or the main body 20. Because the cartridge 10 is a consumable that may be replaced when all the aerosol generating material stored therein are consumed, it may be economic to place the inhalation detecting sensor S in the main body 20.

According to an embodiment, the inhalation detecting sensor S may be located adjacent to the coupling portion 20*a* of the main body 20. For example, the inhalation detecting sensor S may be located in an area adjacent to the coupling portion 20*a* and the outer circumferential surface of the body portion 10*b* of the cartridge 10 coupled to the main body 20. In another example, the inhalation detecting sensor S may be located at an area of the main body 20 (e.g., the accommodating groove 20*a*-1) facing the outer circumferential surface of the housing 100 of the cartridge 10 coupled to the main body 20.

Because the external air may be introduced into the aerosol generating device 1 through a fine gap between the main body 20 and the cartridge 10 that are coupled to each other, the inhalation detecting sensor S may be arranged adjacent to an area where the external air flows, and thus, the pressure change or the flow of air inside the main body 20 may be more accurately detected.

The aerosol generating device 1 may include a processor (e.g., the processor 700 shown in FIG. 1) for controlling the overall operation of the aerosol generating device 1 and a battery 600 for supplying power for the operation of the aerosol generating device 1.

In addition, the aerosol generating device 1 may include an external terminal 20*u* for to be electrically connected to an external device. The external terminal 20*u* may include, for example, a USB terminal. The aerosol generating device 1 may transmit and receive power and data to and from the external device through the external terminal 20*u*.

The aerosol generating device 1 according to an embodiment may include a holding portion 20*m* for holding the mouthpiece 10*m* at a certain position. For example, the main body 20 may include a holding portion 20*m* for holding the closed mouthpiece 10*m* in the closed position. The holding portion 20*m* may be located at an end of the accommodation unit 20*s* accommodating the mouthpiece 10*m* in the closed position. For example, the holding portion 20*m* may be located adjacent to an end of the mouthpiece 10*m* stored in the accommodation unit 20*s*.

When the user moves the mouthpiece 10*m* to the closed position, an external force may be applied to the mouthpiece 10*m* to move from the open position to the closed position. When the mouthpiece 10*m* moves to the closed position, the holding portion 20*m* may provide a retention force to the mouthpiece 10*m* so that the mouthpiece 10*m* is held in the closed position. For example, the holding portion 20*m* may provide magnetic force, elastic force, and/or frictional force to an end of the mouthpiece 10*m* so that the mouthpiece 10*m* is held in the closed position.

When the user moves the mouthpiece 10*m* to the open position, an external force may be applied to the mouthpiece 10*m* to move from the closed position to the open position. For example, when the user presses the other side of the mouthpiece 10*m* with at least a certain force, the mouthpiece 10*m* may be separated from the holding portion 20*m*, and may rotate to the open position from the closed position.

For example, an end of the holding portion 20*m* and an end of the mouthpiece 10*m* may respectively include magnetic bodies with opposite polarities. Accordingly, when an end of the mouthpiece 10*m* becomes adjacent to the closed position by a certain distance, the mouthpiece 10*m* may be held at the closed position by being pulled by magnetic force.

In another example, the holding portion 20*m* may include a locking unit 20*m*-1 that adds a reaction force to an end of the mouthpiece 10*m*. The locking unit 20*m*-1 may add a reaction force in a direction opposite to the direction in which the mouthpiece 10*m* moves so that the mouthpiece 10*m* is not opened in the closed position.

FIG. 8A is an exploded perspective view of some configurations of the cartridge according to an embodiment, FIG. 8B is a perspective view of a combination of the configurations shown in the embodiment of FIG. 8A, and FIG. 8C is a cross-sectional view of the configurations shown in FIG. 8B.

Some configurations of the cartridge shown in FIGS. 8A, 8B, and 8C may be the cartridge or a modification of the cartridge shown in FIG. 7. Hereinafter, overlapping descriptions are omitted.

Referring to FIGS. 8A, 8B, and 8C, some configurations of the cartridge according to an embodiment may include the vibrator 400, the first conductor 410, the second conductor 420, the support 430, the support plate 510, and the circuit board 520.

The first conductor 410 may have a container shape to be in contact with a surface of the vibrator 400 and accommodate at least a portion of the outer circumferential surface of the vibrator 400. An opening may be formed at a portion of the first conductor 410, and at least a portion of the vibrator 400 may be exposed to the outside of the first conductor 410.

The support 430 may be arranged inside the first conductor 410 to support the vibrator 400. At least a portion of the support 430 may be surrounded by the first conductor 410, and at least a portion of the support 430 may be coupled to the first conductor 410 by being forcibly fitted to the first conductor 410.

Here, a surface of the vibrator 400 may be supported by the first conductor 410, and another surface of the vibrator 400 may be supported by the support 430. The support 430, in contact with the other surface of the vibrator 400, may press the vibrator 400 in a direction toward a surface of the first conductor 410, in contact with the surface of the vibrator 400. Accordingly, the vibrator 400 may be prevented from leaving its place or from being damaged during the operation of the vibrator 400.

The support 430 may include at least one protrusion 431 that is surrounded by the first conductor 410. The protrusion 431 may increase a frictional force between the first conductor 410 and the support 430, thereby effectively maintaining the position of the support 430 that is forcibly fixed to the first conductor 410.

The circuit board 520 may be electrically connected to the first conductor 410 and the second conductor 420 to supply signals to the vibrator 400. The circuit board 520 may be fastened to at least some of a portion of the first conductor 410 that surrounds the outer circumferential surface of the vibrator 400. One or more fastening grooves 521 may be formed in the circuit board 520.

The support plate 510 may be arranged between the support 430 and the circuit board 520, and at least a portion of the support plate 510 may be fastened to the circuit board 520 to support the support 430. At least a portion of the support plate 510 may be accommodated in the one or more fastening grooves 521 formed in the circuit board 520. At least a portion of the support plate 510 accommodated in the one or more fastening grooves 521 may reinforce the fastening force of the circuit board 520 and the first conductor 410.

The support plate 510 may include a plane area having a flat shape and an inclined area(s) that is inclined with respect to the plane area such that it may be fastened to the one or more fastening grooves 521. The plane area and the inclined area(s) of the support plate 510 may be integrated so that when pressure is applied to the inclined area(s) such that the inclined area(s) and the plane area become close, the support plate 510 may have elasticity to act as a repulsive force.

In the one or more fastening grooves 521, at least a portion of the first conductor 410 and the inclined area(s) of the support plate 510 may be accommodated. In this case, the plane area of the support plate 510 may be located inside the first conductor 410 of the container form, and the inclined area(s) of the support plate 510 may elastically pressurize at least a portion of the first conductor 410 in a direction from the inside of the first conductor 410 to the outside of the first conductor 410. Accordingly, the fastening force between at least a portion of the first conductor 410 and the circuit board 520 may be reinforced.

In addition, as a repulsion against the elasticity of the inclined area(s), the plane area of the support plate 510 may elastically pressurize the support 430 in a direction toward the surface of the vibrator 400 from the other surface of the vibrator 400, and thus, the support 430 may be kept in closer contact with the vibrator 400.

Here, at least a portion of the first conductor 410 accommodated in the one or more fastening grooves 521 may be coupled to the inclined area(s) of the support plate 510 by welding. Here, various types of welding methods known in the present technical field may be used. For example, at least a portion of the first conductor 410 accommodated in the one or more fastening grooves 521 may be coupled to the inclined arca(s) of the support plate 510 by soldering, but embodiments are not limited thereto. The one or more fastening grooves 521 may be soldered to at least a portion of the first conductor 410 accommodated in the one or more fastening grooves 521, and a portion of the first conductor 410 may be soldered to the inclined area(s) of the support plate 510, but embodiments are not limited thereto. For example, the one or more fastening grooves 521 may only be soldered to at least a portion of the first conductor 410 accommodated in the one or more fastening grooves 521. In addition, the first conductor 410 accommodated in the one or more fastening grooves 521 may only be soldered to the inclined region(s) of the support plate 510 accommodated in the one or more fastening grooves 521.

The second conductor 420 may be in contact with the other surface of the vibrator 400 and press the vibrator 400 in the direction toward the surface of the vibrator 400. The second conductor 420 may have elasticity and may be compressed between the support 430 and the other surface of the vibrator 400 to support the vibrator 400.

FIG. 9A is a perspective view of the support accommodating the second conductor according to an embodiment shown in FIG. 8A, and FIG. 9B is a perspective view of the support of FIG. 9A from a different angle from that of FIG. 9A.

Referring to FIGS. 9A and 9B, the support 430 may include an accommodation space for accommodating the second conductor 420 inside the support 430.

The second conductor 420 may have a coil shape (e.g., may be a coil), and the diameter of the end of the coil shape in contact with the vibrator 400 may be greater than the diameter of the end of the coil shape located inside the accommodation space. The end of the coil shape in contact with the vibrator 400 may have a relatively large diameter so that delivering uniform pressure over the entire area of the vibrator 400 may be possible, and thus the vibrator 400 may be supported more stably.

The second conductor 420 may have a diameter that is substantially similar to the accommodation space of the support 430. In an aerosol generating device using ultrasonic vibration, energy applied to the conductor excluding energy converted into the ultrasonic vibration of the vibrator may be converted to thermal energy. When the temperature of the vibrator 400 rises, the internal capacitance of the vibrator 400 increases and the load increases, thereby providing even more current. As a result, the vibrator 400 may rise to a higher temperature, and the conductors in contact with the vibrator 400 may be deformed in a comparative embodiment.

According to the embodiment, the second conductor 420 may have a diameter that is substantially similar to the accommodation space of the support 430, thereby minimizing the range of deformation of the second conductor 420 due to the heat of the vibrator 400.

The second conductor 420 may be manufactured to have a diameter greater than that of the accommodation space so that when the second conductor 420 is inserted into the accommodation space, the diameter may be reduced to be accommodated inside the accommodation space. For example, when the coil-shaped second conductor 420 is accommodated in the accommodation space, the second conductor 420 may be pressed along the direction in which the coil shape is wound to reduce the diameter of the coil shape. Accordingly, the position of the second conductor 420 accommodated in the accommodation space may be maintained effectively in the accommodation space.

An end of the second conductor 420 may be supported by the support 430. For example, because the end of the second conductor 420 accommodated in the accommodation space penetrates the support 430, and the end of the second conductor 420 that penetrated the support 430 is bent, the second conductor 420 may be supported by the support 430. Accordingly, the holding force of the second conductor 420 may be reinforced inside the support 430, and damage to the second conductor 420 may be prevented.

FIG. 10 is a cross-sectional view of the cartridge for the aerosol generating device according to an embodiment. FIG. 10 may be the cartridge shown in FIG. 7 or a modification of the cartridge. Hereinafter, overlapping descriptions are omitted.

Referring to FIG. 10, the cartridge 10 according to an embodiment may include the first airflow passage 150-1 through which the atomized aerosol is discharged and an atomizing space cover 440 that surrounds the atomizing space 400*c* in which the aerosol is atomized by the vibrator 400.

The atomizing space cover 440 may be connected to the first airflow passage 150-1 and deliver the aerosol to the first airflow passage 150-1, and may limit the aerosol from being leaked to the outside of the airflow passage. If the atomized aerosol splashes on other components of the cartridge 10 by the vibration of the vibrator 400, the other components may be deformed due to the high temperature of the aerosol. The atomizing space cover 440 may limit the contact between aerosol and other components to prevent the deformation of the other components, and may induce the aerosol to be smoothly delivered to the first airflow passage 150-1.

The atomizing space cover 440 may include a material having heat resistance and flexibility (e.g., silicon and rubber) to thereby prevent the deformation by the high temperature aerosol, and, at the same time, be in close contact with the atomizing space 400*c* so that the operation of the vibrator 400 is not limited.

In addition, the atomizing space cover 440 may be in contact with the delivery portion 300, and in this case, by applying pressure to the delivery portion 300, the volume and density etc. of the delivery portion 300 may be adjusted, and as a result, the delivery rate and the delivery amount of the aerosol generating material may be adjusted.

FIG. 11 is a block diagram of an aerosol generating device according to another embodiment.

Referring to FIG. 11, the aerosol generating device 1100 may include a processor 1110, a sensor 1120 (e.g., at least one sensor), an output unit 1130 (e.g., at least one output unit), a battery 1140, an atomizer 1150, a user input unit 1160, a memory 1170, and a communication unit 1180 (e.g., a communication interface). However, the internal structure of the aerosol generating device 1100 is not limited to the structures illustrated in FIG. 11. In other words, according to the embodiment of the aerosol generating device 1100, it will be understood by one of ordinary skill in the art that some of the components shown in FIG. 11 may be omitted or new components may be added.

The sensor 1120 may detect the state of the aerosol generating device 1100 or the state around the aerosol generating device 1100 and deliver the detected information to the processor 1110. Based on the detected information, the processor 1110 may control the aerosol generating device 1100 to perform various functions such as controlling the operation of the atomizer 1150, restricting smoking, determining whether the aerosol generating material (e.g., cigarette, cartridge, etc.) is inserted, and displaying notifications.

The sensor 1120 may include at least one of a temperature sensor 1122, an insertion detecting sensor 1124, and an inhalation detecting sensor 1126, but embodiments are not limited thereto.

The temperature sensor 1122 may detect a temperature of the atomizer 1150 (or the aerosol generating material) being heated. The aerosol generating device 1100 may include a separate temperature sensor that detects the temperature of the atomizer 1150, or the atomizer 1150 itself may serve as a temperature sensor. Alternatively, the temperature sensor 1122 may be arranged around the battery 1140 to monitor the temperature of the battery 1140.

The insertion detecting sensor 1124 may detect the insertion and/or removal of the aerosol generating material. For example, the insertion detecting sensor 1124 may include at least one of a film sensor, a pressure sensor, an optical sensor, a resistance sensor, a capacitive sensor, an inductive sensor, and an infrared sensor, and may detect changes of signals according to the insertion and/or removal of the aerosol generating material.

The inhalation detecting sensor 1126 may detect the user's puff based on various physical changes in the airflow passage or airflow channel. For example, the inhalation detecting sensor 1126 may detect the user's puff based on any one of a change in temperature, flow, voltage, and pressure.

In addition to the above sensors, the sensor 1120 may further include at least one of a temperature/humidity sensor, an atmospheric pressure sensor, a geomagnetic sensor, an acceleration sensor, a gyroscope sensor, a position sensor (e.g., GPS), a proximity sensor, and an RGB sensor (illuminance sensor). Because the function and structure of each sensor may be intuitively inferred from the name by one of ordinary skill in the art, the specific explanation may be omitted.

The output unit 1130 may output and provide information about the state of the aerosol generating device 1100 to the user. The output unit 1130 may include at least one of a display unit 1132, a haptic unit 1134, an acoustic output unit 1136, and a driving unit 1138, but is not limited thereto. When the display unit 1132 and a touchpad form a layer structure and thereby form a touch screen, the display unit 1132 may be used as an input device in addition to an output device.

The display unit 1132 may visually provide information about the aerosol generating device 1100 to the user. For example, information about the aerosol generating device 1100 may indicate various information such as a charging/discharge state of the battery 1140 of the aerosol generating device 1100, an operating state of the atomizer 1150, the insertion/removal state of the cartridge or the aerosol generating material, or a state in which the use of the aerosol generating device 1100 is limited (for example, detection of abnormal material), and the display unit 1132 may output the information to the outside. The display unit 1132 may include, for example, a liquid crystal display panel LCD, an organic light-emitting display panel OLED, etc. In addition, the display unit 1132 may be in the form of an LED light-emitting element.

The haptic unit 1134 may convert electrical signals to a mechanical or electrical stimuli to provide information about the aerosol generating device 1100 tactively to the user. For example, the haptic unit 1134 may include a motor, a piezoelectric element, or an electrical stimulation device.

The acoustic output unit 1136 may audibly provide information about the aerosol generating device 1100 to the user. For example, the acoustic output unit 1136 may convert the electrical signal to an acoustic signal and output the converted signal to the outside.

The battery 1140 may supply power for operating the aerosol generating device 1100. The battery 1140 may supply power for heating the atomizer 1150. Also, the battery 1140 may supply power for the operation of other components (e.g., the sensor 1120, the output unit 1130, the user input unit 1160, the memory 1170, and the communication unit 1180) included in the aerosol generating device 1100. The battery 1140 may be a rechargeable battery or a disposable battery. For example, the battery 1140 may be a lithium polymer (LiPoly) battery, but is not limited thereto.

The atomizer 1150 may heat the aerosol generating material by being supplied with power from the battery 1140. Although not shown in FIG. 11, the aerosol generating device 1100 may further include a power conversion circuit (e.g., a DC/DC converter) for converting the power of the battery 1140 and supplying the converted power to the atomizer 1150. In addition, when the aerosol generating device 1100 generates aerosol in an induction heating method, the aerosol generating device 1100 may further include a DC/AC converter that converts a DC power source of the battery 1140 to an AC power source.

The processor 1110, the sensor 1120, the output unit 1130, the user input unit 1160, the memory 1170, and the communication unit 1180 may receive power from the battery 1140 to function. Although not shown in FIG. 11, a power conversion circuit that converts the power of the battery 1140 and supplies the converted power to each component, for example, a low dropout (LDO) circuit or a voltage regulator circuit, may further be included.

According to an embodiment, the atomizer 1150 may be a heater using a resistance heating method. The heater may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater may be composed of a metal heating wire, a metal heating plate on which an electrically conductive track is arranged, a ceramic heating element, and the like, but is not limited thereto.

According to one or more embodiments, the atomizer 1150 may be a heater using an induction heating method. For example, the atomizer 1150 may include a susceptor that heats the aerosol generating material by generating heat through the magnetic field applied by the coil.

According to one or more embodiments, the atomizer 1150 may be a vibrator that causes ultrasonic vibration. The vibrator may include, for example, piezoelectric ceramics. As electricity is applied to the vibrator, vibrations of short periods and high frequency may be generated, and the generated vibration may break down the aerosol generating material to small particles to thereby atomize to an aerosol.

The user input unit 1160 may receive information input from the user or output the information to the user. For example, the user input unit 1160 may include a key pad, a dome switch, a touchpad (e.g., a touch pad using a touch-sensitive, capacitive method, a pressure resistance method, an infrared sensing method, a surface ultrasonic wave conduction method, an integrated tension measurement method, a piezo effect method, etc.), a jog wheel, a jog switch, etc., but is not limited thereto. In addition, although not shown in FIG. 11, the aerosol generating device 1100 may further include a connection interface such as a universal serial bus (USB) interface, and may be connected to other external devices through the connection interface such as the USB interface to thereby transmit and receive information or charge the battery 1140.

The memory 1170, as a hardware component configured to store various pieces of data processed in the aerosol generating device 1100, may store data processed or to be processed by the processor 1110. The memory 1170 may include at least one type of storage medium among a flash memory type, a hard disk type, a multimedia card micro type, a card type memory (e.g., SD or XD memory, etc.), a random access memory (RAM), a static random access memory (SRAM), a read-only memory (ROM), an electrically erasable programmable read-only memory (EEPROM), a programmable read-only memory (PROM), a magnetic memory, a magnetic disk, or an optical disk. The memory 1170 may store an operation time of the aerosol generating device 1100, the maximum number of puffs, the current number of puffs, at least one temperature profile, data on a user's smoking pattern, etc.

The communication unit 1180 may include at least one component for communication with other electronic devices. For example, the communication unit 1180 may include a short-range wireless communication unit 1182 and a wireless communication unit 1184. According to embodiments, the short-range wireless communication unit 1182 and the wireless communication unit 1184 may include at least one antenna for performing communication.

The short-range wireless communication unit 1182 may include a Bluetooth communication unit, a Bluetooth low energy (BLE) communication unit, a near field communication unit, a WLAN communication unit, a Zigbee communication unit, an infrared data association (IrDA) communication unit, a Wi-fi direct (WFD) communication unit, an ultra wideband (UWB) communication unit, and Ant+ communication unit, etc., but is not limited thereto.

The wireless communication unit 1184 may include, but is not limited to, a cellular network communication unit, an internet communication unit, a computer network (e.g., LAN or WAN) communication unit, etc. The wireless communication unit 1184 may check and verify the aerosol generating device 1100 within a communication network using subscriber information (e.g., international mobile subscriber identifier (IMSI)).

The processor 1110 may control general operations of the aerosol generating device 1100. According to an embodiment, the processor 1110 may include at least one processor. The processor may also include an array of a plurality of logic gates or may also include a combination of a general-purpose microprocessor and a memory in which a program executable in the microprocessor is stored. According to embodiments, the program may be configured to cause the microprocessor to perform the functions of the processor 1110. It will be understood by one of ordinary skill in the art that the processor 1110 can be implemented in other forms of hardware.

The processor 1110 may control the temperature or vibration frequency of the atomizer 1150 by controlling the supply of power of the battery 1140 to the atomizer 1150. For example, the processor 1110 may control the power supply by controlling the switching of a switching element between the battery 1140 and the atomizer 1150. In another example, according to the control command of the processor 1110, a direct heating circuit may control the supply of power to the atomizer 1150.

The processor 1110 may analyze the results detected by the sensor 1120 and control the processes to be performed. For example, the processor 1110 may control power supplied to the atomizer 1150 to start or end an operation of the atomizer 1150 based on the result sensed by the sensor 1120. In another example, the processor 1110 may control the amount of power supplied to the atomizer 1150 and the time of the power being supplied based on the result sensed by the sensor 1120 so that the atomizer 1150 may be heated to a certain temperature or maintained at an appropriate temperature.

The processor 1110 may control the output unit 1130 based on the result sensed by the sensor 1120. For example, when the number of puffs counted through the inhalation detecting sensor 1126 reaches a preset number of times, the processor 1110 may notify the user that the aerosol generating device 1100 will end soon through at least one of the display unit 1132, the haptic unit 1134, and the acoustic output unit 1136.

One embodiment may also be implemented in the form of a non-transitory recording medium including instructions executable by a computer, such as a program module executable by the computer. The non-transitory computer-readable recording medium may be any available medium that can be accessed by a computer and includes both volatile and nonvolatile media, and removable and non-removable media. In addition, the computer-readable recording medium may include both a computer storage medium and a communication medium. The computer storage medium includes all of volatile and nonvolatile, and removable and non-removable media implemented by any method or technology for storage of information such as computer-readable instructions, data structures, program modules, or other data. The communication medium typically includes computer-readable instructions, data structures, other data in modulated data signals such as program modules, or other transmission mechanisms, and includes any information transfer media.

Those of ordinary skill in the art related to the present disclosure understand that various changes in form and details can be made to embodiments of the present disclosure without departing from the scope of the present disclosure. The disclosed methods should be considered in a descriptive sense only and not for purposes of limitation.

The invention claimed is:

1. A cartridge for an aerosol generating device, the cartridge comprising:

a storage container in which an aerosol generating material is stored;

a vibrator configured to atomize the aerosol generating material stored in the storage container into an aerosol by generating vibrations;

a delivery portion configured to deliver the aerosol generating material stored in the storage container to the vibrator;

a first conductor having a container shape, the first conductor in contact with a first surface of the vibrator and accommodating at least a portion of an outer circumferential surface of the vibrator;

a second conductor in contact with a second surface of the vibrator and pressing the vibrator in a direction from the second surface to the first surface; and a support located inside the first conductor and configured to support the vibrator, wherein the cartridge further comprises a circuit board electrically connected to the first conductor and the second conductor, and a support plate located between the support and the circuit board, and wherein the circuit board comprises a fastening groove into which both the first conductor and a portion of the support plate are accommodated.

2. The cartridge for the aerosol generating device of claim 1, wherein at least a portion of the support is surrounded by the first conductor, and the portion of the support surrounded by the first conductor comprises at least one protrusion.

3. The cartridge for the aerosol generating device of claim 1, wherein an end of the second conductor is supported by the support.

4. The cartridge for the aerosol generating device of claim 1, wherein the second conductor has elasticity and is compressed between the support and the second surface of the vibrator such as to support the vibrator.

5. The cartridge for the aerosol generating device of claim 1, wherein the support includes an accommodation space that accommodates the second conductor inside the support.

6. The cartridge for the aerosol generating device of claim 5, wherein the second conductor has a coil shape, the coil shape comprising a first end in contact with the vibrator and a second end that is located inside the accommodation space, and a diameter of the first end of the coil shape is greater than a diameter of the second end of the coil shape.

7. The cartridge for the aerosol generating device of claim 1, wherein the circuit board comprises a resistor that reduces noise of a signal applied to the vibrator.

8. The cartridge for the aerosol generating device of claim 1, wherein at least a portion of the first conductor that surrounds the outer circumferential surface of the vibrator is fastened to the circuit board.

9. The cartridge for the aerosol generating device of claim 1, wherein at least a portion of the support plate is coupled to the circuit board.

10. The cartridge for the aerosol generating device of claim 9, wherein the portion of the support plate that is accommodated in the fastening groove is inclined in a direction from the first surface to the second surface of the vibrator.

11. The cartridge for the aerosol generating device of claim 1, further comprising:

an airflow passage that is configured to discharge an atomized aerosol; and an atomizing space cover surrounding an atomizing space in which the vibrator is configured to atomize the aerosol, the atomizing space cover configured to allow the aerosol to be delivered from the atomizing space to the airflow passage while limiting the aerosol from leaking to an outside of the airflow passage.

12. The cartridge for the aerosol generating device of claim 1, further comprising an absorbent located between the delivery portion and the vibrator, the absorbent configured to deliver the aerosol generating material delivered from the delivery portion to the vibrator.

13. The cartridge for the aerosol generating device of claim 12, wherein the delivery portion comprises a material having an aerosol generating material absorption rate that is faster than an aerosol generating material absorption rate of the absorbent.

14. An aerosol generating device comprising:

the cartridge of claim 1; and a main body to which the cartridge is detachably coupled, wherein the main body for the aerosol generating device comprises:

a housing comprising an accommodating groove into which at least a portion of the cartridge is inserted; and a battery configured to supply power to the cartridge.

* * * * *